US006561963B2

(12) United States Patent
Totani

(10) Patent No.: US 6,561,963 B2
(45) Date of Patent: May 13, 2003

(54) PLASTIC BAG MAKING APPARATUS

(75) Inventor: Mikio Totani, Muko (JP)

(73) Assignee: Totani Corporation, Kyoto (JP)

( * ) Notice: Subject to any disclaimer, the term of this patent is extended or adjusted under 35 U.S.C. 154(b) by 0 days.

(21) Appl. No.: 09/726,387

(22) Filed: Dec. 1, 2000

(65) Prior Publication Data

US 2001/0002938 A1 Jun. 7, 2001

(30) Foreign Application Priority Data

Dec. 2, 1999 (JP) ..... 11-343685
Dec. 9, 1999 (JP) ..... 11-350767

(51) Int. Cl.[7] ..... B31B 1/90

(52) U.S. Cl. ..... 493/218; 493/449; 493/505; 493/288; 493/189

(58) Field of Search ..... 493/936, 449, 493/405, 455, 269, 287, 288, 341, 189, 200, 250, 218, 219

(56) References Cited

U.S. PATENT DOCUMENTS

| | | | | | |
|---|---|---|---|---|---|
| 1,631,452 | A | | 6/1927 | Appel | |
| 3,917,159 | A | * | 11/1975 | Platz et al. | 383/104 |
| 4,452,378 | A | * | 6/1984 | Christine | 222/107 |
| 4,610,651 | A | * | 9/1986 | Jacobson et al. | 493/212 |
| 4,918,906 | A | * | 4/1990 | Ako | |
| 5,102,384 | A | * | 4/1992 | Ross et al. | 493/243 |
| 5,171,202 | A | * | 12/1992 | Su | 493/189 |
| 5,174,658 | A | * | 12/1992 | Cook et al. | 150/900 |
| 5,275,491 | A | * | 1/1994 | Kuge et al. | 383/120 |
| 5,468,206 | A | * | 11/1995 | Buchanan | 493/189 |
| 6,056,681 | A | * | 5/2000 | Ross | 493/197 |

FOREIGN PATENT DOCUMENTS

| | | | | |
|---|---|---|---|---|
| GB | 2 310 194 A | | 8/1997 | |
| JP | 10194206 A | * | 1/1997 | B65B/7/02 |
| JP | 2000254891 | * | 3/1999 | B26D/3/08 |

OTHER PUBLICATIONS

Patent Abstracts of Japan, vol. 2000, 05, Sep. 14, 2000; & JP 2000 062795 A. (Totani Giken Kogyo KK), Feb. 29, 2000.

* cited by examiner

*Primary Examiner*—Rinaldi I. Rada
*Assistant Examiner*—Louis Tran
(74) *Attorney, Agent, or Firm*—Armstrong, Westerman & Hattori, LLP

(57) ABSTRACT

An apparatus is arranged to successively make plastic bags each of which includes two layers of panel portion superposed to define aligned top edges, first and second side edges and bottom edges. The plastic bag further includes a first side gusset portion disposed between and extending along the first side edges, a second side gusset portion disposed between and extending along the second side edges, and a bottom gusset portion disposed between and extending along the bottom edges. The apparatus comprises feeding means for feeding a main material intermittently for a length along a feeding path. The main material comprises the layers of panel portion and the first and second side gusset portions continuing longitudinally thereof respectively, the feeding means feeding the main material longitudinally of the layers of panel portion and the first and second side gusset portions. The apparatus further comprises cutting means disposed at a position predetermined along the feeding path for cutting one of the layers of panel portion as well as the first and second side gusset portions widthwise of the main material and leaving the other layer of panel portion continuing, to form an opening in the main material, whenever feeding the main material intermittently. The apparatus further comprises inserting means disposed downstream of the cutting means along the feeding path for inserting an additional material between the layers of panel portion through the opening, whenever feeding the main material intermittently. The additional material comprises the bottom gusset portion.

13 Claims, 23 Drawing Sheets

Fig. 19
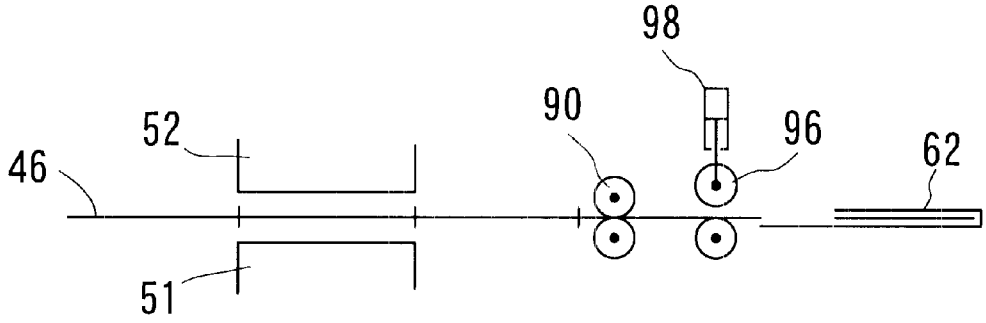
Fig. 20
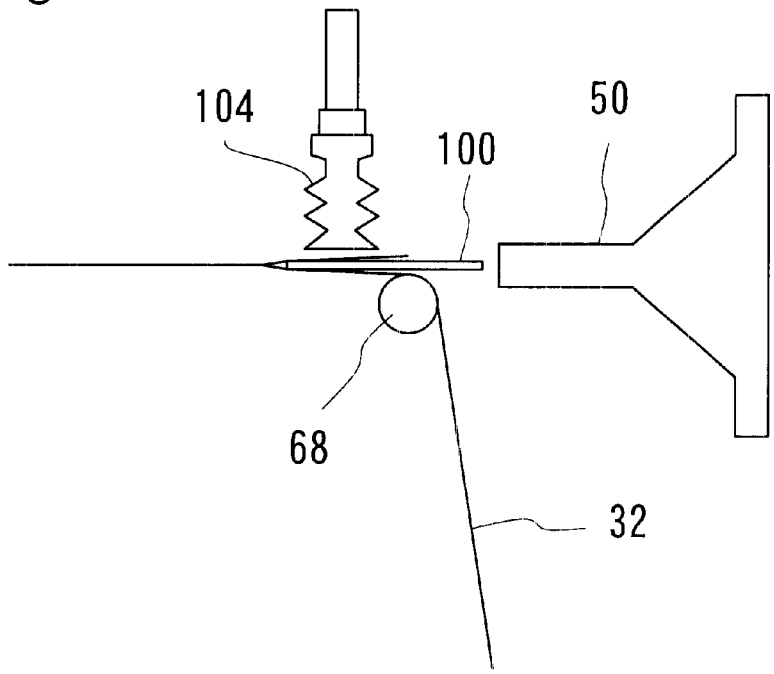
Flg. 21
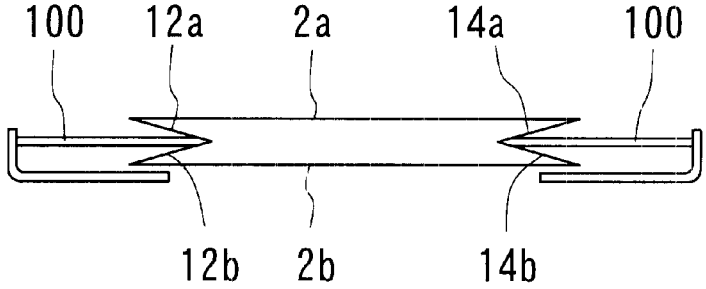

PLASTIC BAG MAKING APPARATUS

FIELD OF THE INVENTION

The invention relates to an apparatus for successively making plastic bags.

PRIOR ART

There has been recently requested to successively make plastic bags each of which is completed with first and second gusset portions and a bottom gusset portion. The plastic bag includes two layers of panel portion superposed to define aligned top edges, first and second side edges and bottom edges. The first side gusset portion is disposed between the first side edges to extend therealong. The second side gusset portion is disposed between the second side edges to extend therealong. Each of the first and second side gusset portions is folded into halves along a center line extending longitudinally thereof, superposed into two layers and interposed between the layers of panel portion. The first side edges are connected with each other by the first side gusset portion, the second side edges being connected with each other by the second side gusset portion.

On the other hand, the bottom gusset portion is disposed between the bottom edges to extend therealong. The bottom gusset portion is also folded into halves along a center line extending longitudinally thereof, superposed into two layers and interposed between the layers of panel portion. The bottom edges are connected with each other by the bottom gusset portion. In addition, the bottom gusset portion has first and second ends at which first and second auxiliary gusset portions are formed. Each of the first and second auxiliary gusset portions is folded from the layers of bottom gusset portion along folded lines extending at an angle of about 45° with respect to the center line of bottom gusset portion. The first auxiliary gusset portion is further folded into halves along a center line which is an extension of the center line of bottom gusset portion, to be superposed into two layers one of which is interposed along with one of the layers of bottom gusset portion between one of the layers of panel portion and one of the layers of first side gusset portion. The other layer of first auxiliary gusset portion is folded along with the other layer of bottom gusset portion between the other layer of panel portion and the other layer of first side gusset portion. The first side gusset portion is connected with the bottom gusset portion by the first auxiliary gusset portion. The second auxiliary gusset portion is further folded into halves along a center line which is an extension of the center line of bottom gusset portion, to be superposed into two layers one of which is interposed along with one of the layers of bottom gusset portion between one of the layers of panel portion and one of the layers of second side gusset portion. The other layer of second auxiliary gusset portion is folded along with the other layer of bottom gusset portion between the other layer of panel portion and the other layer of second side gusset portion. The second side gusset portion is connected with the bottom gusset portion by the second auxiliary gusset portion.

Accordingly, the plastic bag is advantageous in that the first and second side gusset portions can be unfolded between the first and second side edges respectively to obtain a large capacity. The bottom gusset portion and the first and second auxiliary gusset portions can also be unfolded between the bottom edges to constitute a rectangular bottom. The plastic bag can therefore stably stand on a table.

However, it has been heretofore difficult to successively the plastic bags.

It is therefore an object of the invention to provide a new and improved apparatus for successively making plastic bags each of which is completed with first and second side gusset portions and a bottom gusset portion.

SUMMARY OF THE INVENTION

According to the invention, an apparatus is arranged to successively make plastic bags each of which includes two layers of panel portion superposed to define aligned top edges, first and second side edges and bottom edges. The plastic bag further includes a first side gusset portion disposed between and extending along the first side edges, a second side gusset portion disposed between and extending along the second side edges, and a bottom gusset portion disposed between and extending along the bottom edges.

The apparatus comprises feeding means for feeding a main material intermittently for a length along a feeding path. The main material comprises the layers of panel portion and the first and second side gusset portions continuing longitudinally thereof respectively, the feeding means feeding the main material longitudinally of the layers of panel portion and the first and second side gusset portions. The apparatus further comprises cutting means disposed at a position predetermined along the feeding path for cutting one of the layers of panel portion as well as the first and second side gusset portions widthwise of the main material and leaving the other layer of panel portion continuing, to form an opening in the main material, whenever feeding the main material intermittently. The apparatus further comprises inserting means disposed downstream of the cutting means along the feeding path for inserting an additional material between the layers of panel portion through the opening, whenever feeding the main material intermittently. The additional material comprises the bottom gusset portion.

In a preferred embodiment, the cutting means comprises a Thomson blade extending widthwise of and opposed to one of the layers of panel portion. The cutting means further comprises drive means for moving the Thomson blade toward one of the layers of panel portion to cut one of the layers of panel portion as well as the first and second side gusset portions widthwise of the main material.

Each of the first and second side gusset portions is folded into halves along a center line extending longitudinally thereof, superposed into two layers and interposed between the layers of panel portion. The first side edges are connected with each other by the first side gusset portion, the second side edges being connected with each other by the second gusset portion. The bottom gusset portion is folded into halves along a center line extending longitudinally thereof, superposed into two layers and interposed between the layers of panel portion. The bottom edges are connected with each other by the bottom gusset portion. In addition, the bottom gusset portion has first and second ends at which first and second auxiliary gusset portions are formed. Each of the first and second auxiliary gusset portions is folded from the layers of bottom gusset portion along folded lines extending at an angle of about 45° with respect to the center line of bottom gusset portion. The first auxiliary gusset portion is further folded into halves along a center line which is an extension of the center line of bottom gusset portion, to be superposed into two layers one of which is interposed along with one of the layers of bottom gusset portion between one of the layers of panel portion and one of the layers of first side gusset portion. The other layer of first auxiliary gusset portion is interposed along with the other layer of bottom gusset portion between the other layer of panel portion and the other layer of first side gusset portion. The first side gusset portion is connected with the bottom gusset portion by the first auxiliary gusset portion. The second auxiliary gusset portion is further folded into halves along a center line which is an extension of the center line of bottom gusset portion, to be superposed into two layers one of which is interposed along with one of the layers of bottom gusset portion between one of the layers of panel portion and one of the layers of second side gusset portion. The other layer of second auxiliary gusset portion is interposed along with the other layer of bottom gusset portion between the other layer of panel portion and the other layer of second side gusset portion. The second side gusset portion is connected with the bottom gusset portion by the second auxiliary gusset portion.

The inserting means comprises a spatula adapted to be pressed against the center line of bottom gusset portion to insert the additional material between the layers of panel portion through the opening.

The apparatus further comprises guide means through which the additional material passes to be folded along the center line of bottom gusset portion and the folded lines of first and second auxiliary gusset portions, when inserting the additional material by the spatula.

The apparatus further comprises folded tendency making means for making the additional material having a tendency to be folded along the center line of bottom gusset portion and the folded lines of first and second auxiliary gusset portions, the spatula being pressed against the center line of bottom gusset portion to insert the additional material, after making the additional material having a tendency to be folded.

In other embodiment, the inserting means comprises an autohand arranged to clamp or suctionally attract the additional material which has been previously folded along the center line of bottom gusset portion, the folded lines of first and second auxiliary gusset portions and the center lines of first and second auxiliary gusset portions, the auto hand inserting the additional material between the layers of panel portion through the opening.

The apparatus further comprises bottom gusset sealing means disposed downstream of the inserting means along the feeding path for heat sealing the layers of panel portion with the layers of bottom gusset portion and heat sealing the layers of first and second auxiliary gusset portions with the layers of first and second side gusset portions along the opening respectively, whenever feeding the main material intermittently.

A cutter is disposed downstream of the bottom gusset sealing means along the feeding path for cutting the other layer of panel portion along the opening to form the bottom edges of plastic bag, whenever feeding the main material intermittently.

The cutter may be arranged to cut the other layer of panel portion as well as one of the layers of panel portion, the layers of bottom gusset portion, the layers of first and second auxiliary gusset portions and the layers of first and second side gusset portions along the opening to form the bottom edges of plastic bag.

The cutter may be further arranged to cut the other layer of panel portion as well as one of the layers of panel portion, the layers of bottom gusset portion, the layers of first and second auxiliary gusset portion and the layers of first and second side gusset portions at two positions predetermined downstream and upstream of the opening.

The apparatus may further comprises side gusset sealing means disposed upstream of the inserting means along the feeding path for heat sealing the layers of panel portion with the layers of first and second side gusset portions along the first and second side edges respectively so as to form non-sealing portions within the range of seal width, whenever feeding the main material intermittently. The non-sealing portions are spaced from each other along the first and second side edges. The inserting means then inserts the additional material between the layers of panel portion to make the bottom gusset portion and the first and second auxiliary gusset portions invading the non-sealing portions. The bottom sealing means then heat seals the layers of panel portion with the layers of bottom gusset portion and heat seals the layers of first and second auxiliary gusset portion with the layers of first and second side gusset portion along the opening respectively.

The bottom gusset sealing means may be arranged to further heat seal the layers of panel portion with the layers of bottom gusset portion and the layers of first and second side gusset portions and heat seal the layers of first and second auxiliary gusset portions with the layers of first and second side gusset portions at corners between the bottom edges and the first and second side edges respectively, to form joining lines extending to traverse obliquely the bottom edges and the first and second side edges.

The joining lines may comprise straight or curved lines.

The cutter may be arranged to cut the layers of panel portion, the layers of bottom gusset portion, the layers of first and second auxiliary gusset portions and the layers of first and second side gusset portions along the joining lines.

According to the invention, there is also provided a plastic bag in which the layers of panel portion are heat sealed with the layers of bottom gusset portion along the bottom edges respectively so that the bottom edges are connected with each other by the bottom gusset portion. The layers of first and second auxiliary gusset portions are heat sealed with the layers of first and second side gusset portions along the bottom edges respectively so that the first and second side gusset portions are connected with the bottom gusset portion by the first and second auxiliary gusset portions. In addition, the layers of panel portion are heat sealed with the layers of first and second side gusset portions along the first and second side edges respectively so that the first side edges are connected with each other by the first side gusset portion, the second side edges being connected with each other by the second side gusset portion. The bottom gusset portion and the first and second auxiliary gusset portions invade the ranges of seal width of the layers of panel portion with the layers of first and second side gusset portions.

There is also provided a plastic bag in which the first side edges are connected with each other by the first side gusset portion, the second side edges being connected with each other by the second side gusset portion, the bottom edges being connected with each other by the bottom gusset portion. The plastic bag includes joining lines formed at corners between the bottom edges and the first and second side edges and extending to traverse obliquely the bottom edges and the first and second side edges. The layers of panel portion are joined with the layers of bottom gusset portion and the layers of first and second side gusset portions along the joining lines. The layers of first and second auxiliary gusset portions are joined with the layers of first and second side gusset portions along the joining lines so that the first and second side gusset portions are connected with the bottom gusset portion by the first and second auxiliary gusset portions.

In the plastic bag, the joining lines may comprise heat seal lines, the layers of panel portion being heat sealed and joined with the layers of bottom gusset portion and the layers of first and second side gusset portions along the heat seal lines, the layers of first and second auxiliary gusset portions being heat sealed and joined with the layers of first and second side gusset portions along the heat seal lines.

The joining lines may comprise straight or curves lines.

It is preferable that the layers of panel portion, the layers of bottom gusset portion, the layers of first and second auxiliary gusset portions and the layers of first and second side gusset portions are corner cut along the joining lines.

It is also preferable that the layers of panel portion are spot joined with the layers of bottom gusset portion, the layers of first and second auxiliary gusset portions and the layers of first and second side gusset portions respectively at positions adjacent the bottom edges and between the center lines of the first and second side gusset portions and the joining lines.

BRIEF DESCRIPTION OF THE DRAWINGS

FIG. 19 is a plan view of the additional material of FIG. 17.

FIG. 20 is an enlarged view of the main material of FIG. 17.

FIG. 21 is an elevational view of the main material of FIG. 20.

DETAILED DESCRIPTION OF THE PREFERRED EMBODIMENT

Figure 1:
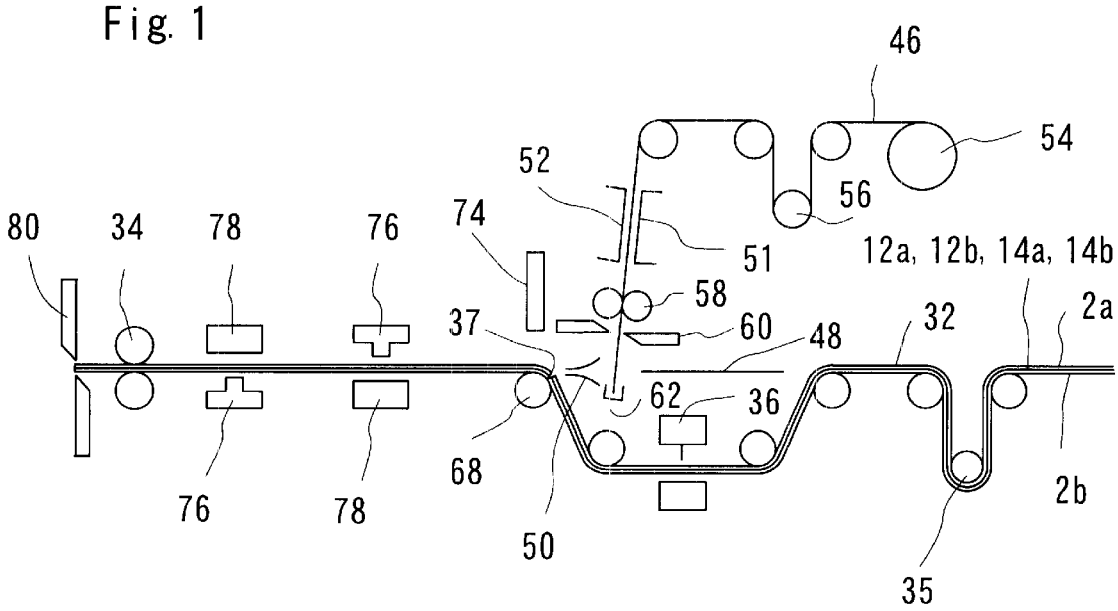
FIG. 1 is a side view of a preferred embodiment of the invention.
Figure 2:
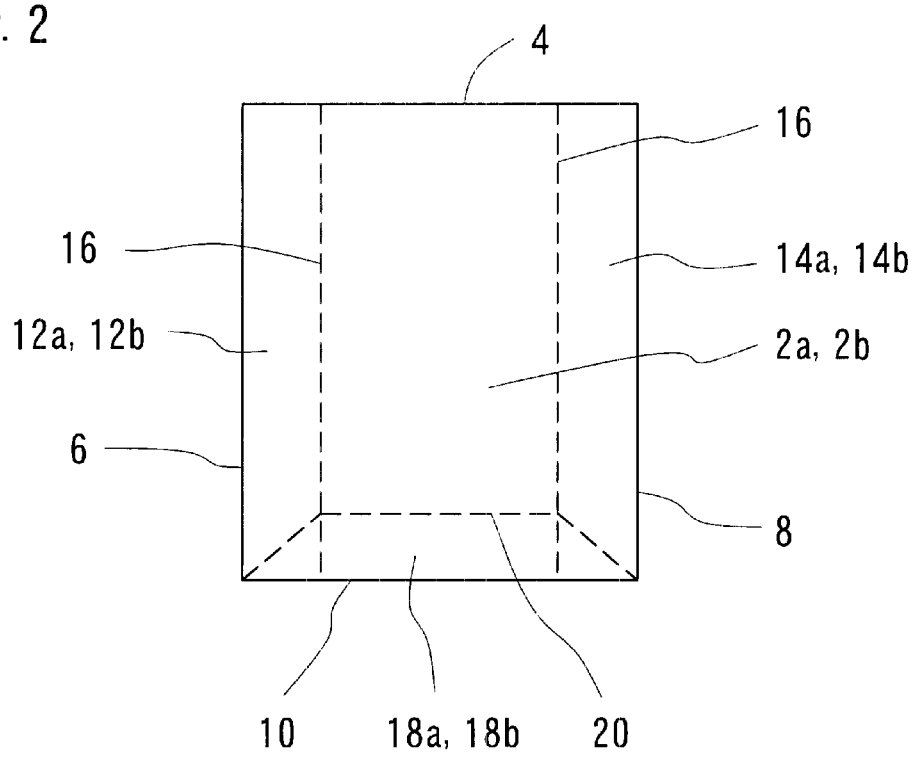
FIG. 2 is an elevational view of a plastic bag to be made by the apparatus of FIG. 1.
Figure 3:
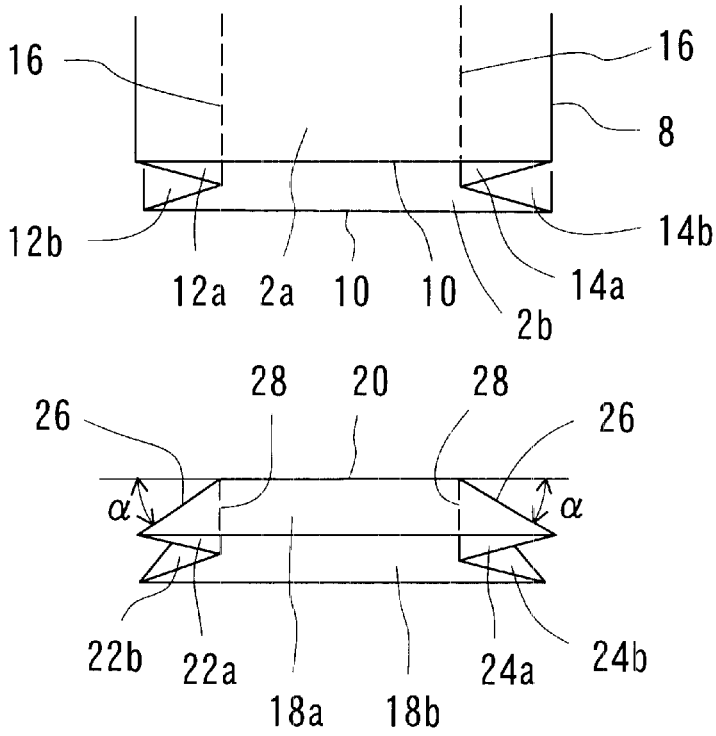
FIG. 3 is a perspective view of the plastic bag of FIG. 2 with the bottom gusset portion removed.

Referring now to the drawings, FIG. 1 illustrates an apparatus for successively making plastic bags according to the invention. The plastic bag includes two layers of panel portion 2*a* and 2*b* superposed to define aligned top edges 4, first and second side edges 6 and 8 and bottom edges 10, as shown in FIG. 2 and FIG. 3. The plastic bag further includes a first side gusset portion 12*a* and 12*b* disposed between and extending along the first side edges 6. The plastic bag further includes a second side gusset portion 14*a* and 14*b* disposed between and extending along the second side edges 8. Each of the first and second side gusset portions 12*a*, 12*b*, 14*a* and 14*b* is folded into halves along a center line 16 extending longitudinally thereof, superposed into two layers and interposed between the layers of panel portion 2*a* and 2*b*. The first side edges 6 are connected with each other by the first side gusset portion 12*a* and 12*b*, the second side edges 8 being connected with each other by the second side gusset portion 14*a* and 14*b*.

Figure 4:
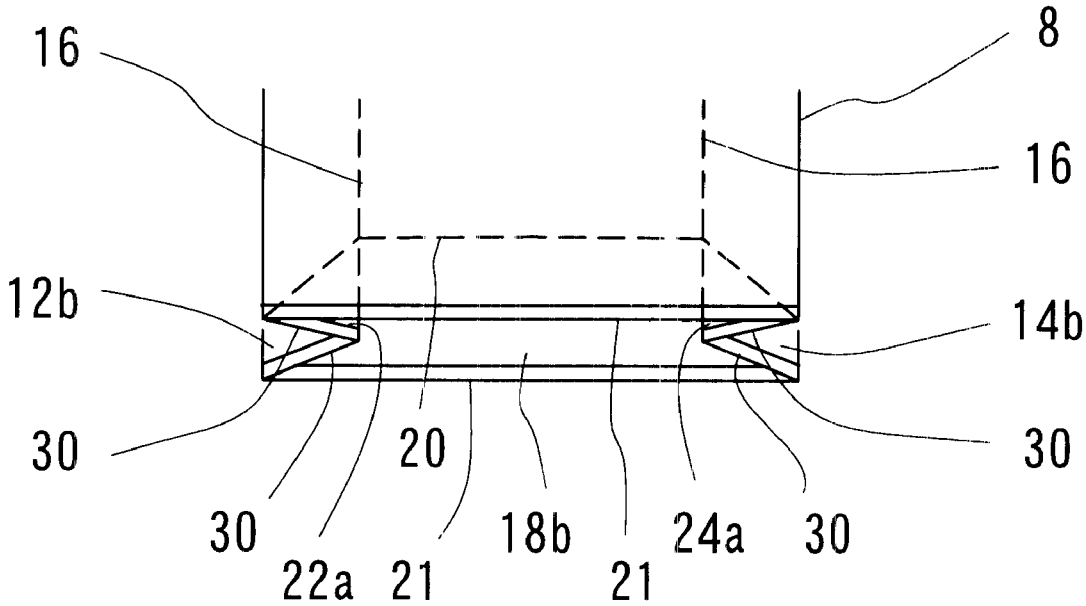
FIG. 4 is a perspective view of the plastic bag of FIG. 3 with the bottom gusset portion incorporated.

The plastic bag further includes a bottom gusset portion 18*a* and 18*b* disposed between and extending along the bottom edges 10. The bottom gusset portion 18*a* and 18*b* is also folded into halves along a center line 20 extending longitudinally thereof, superposed into two layers and interposed between the layers of panel portion 2*a* and 2*b*. The layers of panel portion 2*a* and 2*b* are heat sealed with the layers of bottom gusset portion 18*a* and 18*b* along the bottom edges 10 to form heat seal lines 21, as shown in FIG. 4. Accordingly, the bottom edges 10 are connected with each other by the bottom gusset portion 18*a* and 18*b*.

In addition, the bottom gusset portion 18*a* and 18*b* has first and second ends at which first and second auxiliary gusset portions 22*a*, 22*b*, 24*a* and 24*b* are formed. Each of the first and second auxiliary gusset portions 22*a*, 22*b*, 24*a* and 24*b* is folded from the layers of bottom gusset portion 18*a* and 18*b* along folded lines 26 extending at an angle $\alpha$ of about 45° with respect to the center line 20 of bottom gusset portion 18*a* and 18*b*.

The first auxiliary gusset portion 22*a* and 22*b* is further folded into halves along a center line 28 which is an extension of the center line 20 of bottom gusset portion 18*a* and 18*b*, to be superposed into two layers one of which 22*a* is interposed along with one of the layers of bottom gusset portion 18*a* between one of the layers of panel portion 2*a* and one of the layers of first side gusset portion 12*a*. The other layer of first auxiliary gusset portion 22*b* is interposed along with the other layer of bottom gusset portion 18*b* between the other layer of panel portion 2*b* and the other layer of first side gusset portion 12*b*. The layers of first auxiliary gusset portion 22*a* and 22*b* are heat sealed with the layers of first side gusset portion 12*a* and 12*b* along the bottom edges 10 to form heat seal lines 30. Accordingly, the first side gusset portion 12*a* and 12*b* is connected with the bottom gusset portion 18*a* and 18*b* by the first auxiliary gusset portion 22*a* and 22*b*.

The second auxiliary gusset portion 24*a* and 24*b* is further folded into halves along a center line 28 which is an extension of the center line 20 of bottom gusset portion 18*a* and 18*b*, to be superposed into two layers one of which 24*a* is interposed along with one of the layers of bottom gusset portion 18*a* between one of the layers of panel portion 2*a* and one of the layers of second side gusset portion 14*a*. The other layer of second auxiliary gusset portion 24*b* is interposed along with the other layer of bottom gusset portion 18*b* between the other layer of panel portion 2*b* and the other layer of second side gusset portion 14*b*. The layers of second auxiliary gusset portion 24*a* and 24*b* are heat sealed with the layers of second side gusset portions 14*a* and 14*b* along the bottom edges 10 to form heat seal lines 30. Accordingly, the second side gusset portion 14*a* and 14*b* is connected with the bottom gusset portion 18*a* and 18*b* by the second auxiliary gusset portion 24*a* and 24*b*.

The first and second side gusset portions 12*a*, 12*b*, 14*a* and 14*b* can therefore be unfolded between the first and second side edges 6 and 8 respectively to obtain a large capacity. The bottom gusset portion 18*a* and 18*b* and the first and second auxiliary gusset portions 22*a*, 22*b*, 24*a* and 24*b* can also be unfolded between the bottom edges 10 to constitute a rectangular bottom. The plastic bag can therefore stably stand on a table.

Figure 6:
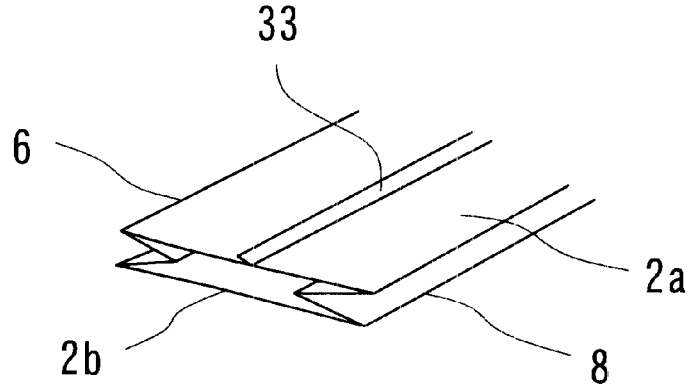
FIG. 6 is a perspective view of other embodiment.
Figure 5:
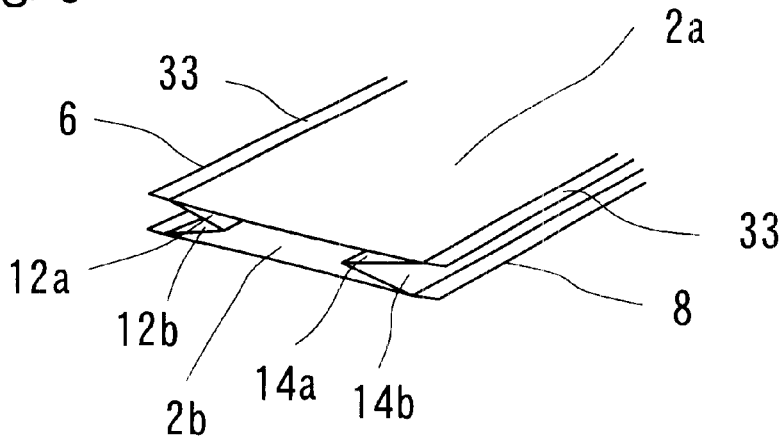
FIG. 5 is a perspective view of the main material of FIG. 1.
Figure 7:
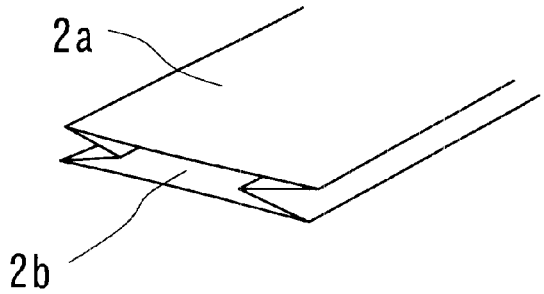
FIG. 7 is a perspective view of other embodiment.

The apparatus includes feeding means for feeding a main material 32 intermittently for a length along a feeding path. The main material 32 comprises the layers of panel portion 2*a* and 2*b* and the first and second side gusset portions 12*a*, 12*b*, 14*a* and 14*b* continuing longitudinally thereof respectively, as shown in FIG. 5, the feeding means feeding the main material 32 longitudinally of the layers of panel portion 2*a* and 2*b* and the first and second side gusset portions 12*a*, 12*b*, 14*a* and 14*b*. In the embodiment, the main material 32 is obtained by heat sealing the layers of panel portion 2*a* and 2*b* with the layers of first and second side gusset portions 12*a*, 12*b*, 14*a* and 14*b* along the first and second side edges 6 and 8 respectively, to form heat seal lines 33 extending along the first and second side edges 6 and 8. The main material 32 may be obtained by heat sealing the superposed portions of one of the layers of panel portion 2*a* with each other, to form a heat seal line 33 extending longitudinally of one of the layers of panel portion 2*a*, as shown in FIG. 6. The main material 32 may be obtained by inflation molding without heat seal line, as shown in FIG. 7. The feeding means comprises a pair of feed rollers 34 between which the main material 32 is directed. The feed rollers 34 are rotated by a drive motor, not shown, to feed the main material 32 intermittently, through a tension roller 35.

Figure 8:
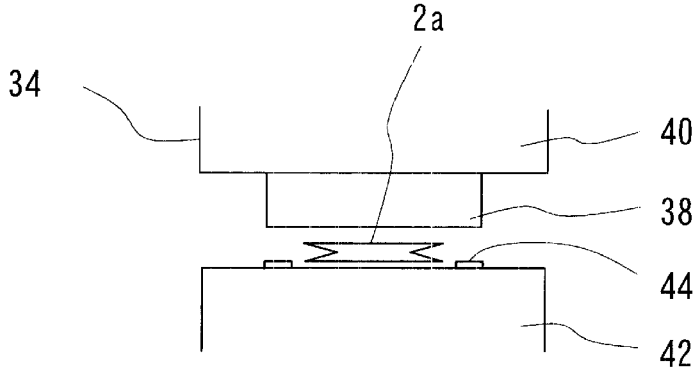
FIG. 8 is an elevational view of the cutting means of FIG. 1.

The apparatus further includes cutting means 36 disposed at a position predetermined along the feeding path for cutting one of the layers of panel portion 2*a* as well as the first and second side gusset portions 12*a*, 12*b*, 14*a* and 14*b* widthwise of the main material 32 and 2*b* and leaving the other layer of panel portion 2*b* continuing, to form an opening 37 in the main material 32, whenever feeding the main material 32 intermittently and during stopping the main material 32. In the embodiment, the cutting means 36 comprises a Thomson blade 38 extending widthwise of and opposed to one of the layers of panel portion 2*a*, as shown in FIG. 8. The cutting means 36 further comprises drive means including a carriage 40 on which the Thomson blade 38 is mounted. The carriage 40 is lowered toward a table 42 for moving the Thomson blade 38 toward one of the layers of panel portion 2*a* to cut one of the layers of panel portion 2*a* as well as the first and second side gusset portions 12*a*, 12*b*, 14*a* and 14*b* widthwise of the main material 32, to thereby form the opening 37. In this connection, the Thomson blade 38 is brought into contact with metal adjusters 44 disposed on the table 42. Each of the adjusters 44 has a thickness corresponding to the thickness of the other layer of panel portion 2*b* so that the Thomson blade 38 does not cut the other layer or panel portion 2*b* to leave it continuing. The cutting means 36 may be arranged to move the Thomson blade 38 toward one of the layers of panel portion 2*a* and stop it at a position in which the Thomson blade 38 is spaced from the table 42 at a distance corresponding to the other layer of panel portion 2*b*. This can also cut one of the layers of panel portion 2*a* as well as the first and second side gusset portions 12*a*, 12*b*, 14*a* and 14*b* and leave the other layer of panel portion 2*b* continuing. Accordingly, the feed rollers 34 can then feed the main material 32 by the other layer of panel portion 2*b* when rotated by the drive motor.

The apparatus further includes inserting means disposed downstream of the cutting means 36 along the feeding path for inserting an additional material 46 between the layers of panel portions 2*a* and 2*b* through the opening 37, whenever feeding the main material 32 intermittently and during stopping the main material 32. In the embodiment, the inserting means includes a spatula 48 associated with guide means 50 and folded tendency making means.

Figure 9:
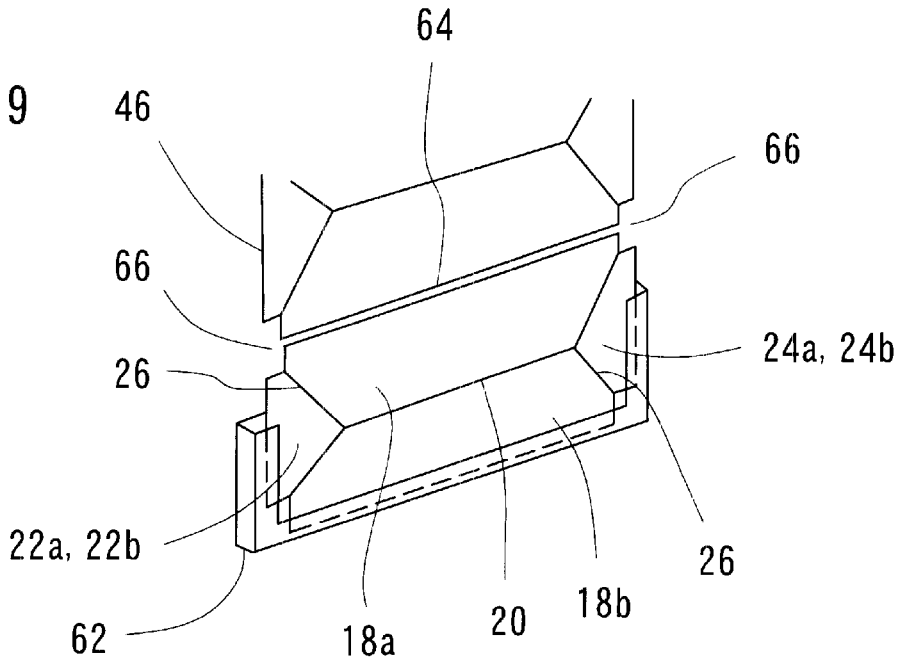
FIG. 9 is a perspective view of the holder of FIG. 1.

The folded tendency making means comprises a heater or press 51 and a receiver 52 spaced from each other, the additional material 46 comprising the bottom gusset portion 18*a* and 18*b* continuing widthwise thereof. The additional material 46 is directed between the heater or press 51 and the receiver 52 from a supply roll 54 through a tension roller 56. The additional material 46 is further directed between a pair of feed rollers 58 which are rotated by a drive motor to feed the additional material 46 intermittently for a length and widthwise of the bottom gusset portion 18*a* and 18*b*. The heater or press 51 and the receiver 52 are connected to drive means such as cylinders which move the heater or press 51 and the receiver 52 toward each other so that the additional material 46 is sandwiched between the heater or press 51 and the receiver 52. The heater or press 51 includes an elongated edge formed thereon and pressed against the additional material 46, the elongated edge heating and pressurizing the additional material 46 for making it to be folded in the case of heater, the elongated edge pressurizing the additional material 46 for making it to be folded in the case of press. The elongated edge has a length and pattern predetermined to make the additional material 46 having a tendency to be folded along the center line 20 of bottom gusset portion 18*a* and 18*b* and the folded lines 26 of first and second auxiliary gusset portions 22*a*, 22*b*, 24*a* and 24*b*, as shown in FIG. 9.

In addition, a cutter 60 and a holder 62 are disposed below the feed rollers 58 which feed the additional material 46 intermittently for a length and downwardly, after making the additional material 46 having a tendency to be folded, so that the additional material 46 is inserted into the holder 62. The cutter 60 cuts the additional material 46 along a cutting line 64 extending between adjacent bottom gusset portions 18*a* and 18*b*, whenever feeding the additional material 46 intermittently and during stopping it. The additional material 46 or a bottom gusset portion 18*a* and 18*b* is therefore dropped into and held in the holder 62. The holder 62 is channel-shaped in which the bottom gusset portion 18*a* and 18*b* is held at three sides. In the embodiment, punching means is incorporated into the heater or press 51 or the cutter 60 to form notches 66 between the adjacent bottom gusset portions 18*a* and 18*b* at the opposite ends thereof.

On the other hand, the main material 32 is directed to a guide roller 68 disposed downstream of the cutting means 36, the opening 37 reaching the guide roller 68 whenever feeding the main material 32 intermittently for a length. The main material 32 is curved by the guide roller 68 to open the opening 37 at a position corresponding to the the holder 62 so that the additional material 46 is held in the holder 62 and opposed to the opening 37 in the main material 32. The apparatus may include suction pads adapted to suctionally attract and lift one of the layers of panel portion 2*a* to reliably open the opening 37. It may include air jets adapted to blow air toward the opening 37 to reliably open the opening 37.

The spatula 48 is connected to and operated by drive means such as cylinders and pressed against the center line 20 of bottom gusset portion 18*a* and 18*b* to push the additional material 46 out of the holder 62 and insert it between the layers of panel portion 2*a* and 2*b* through the opening 37, after making the additional material 46 having the tendency to be folded and cutting it.

Figure 10:
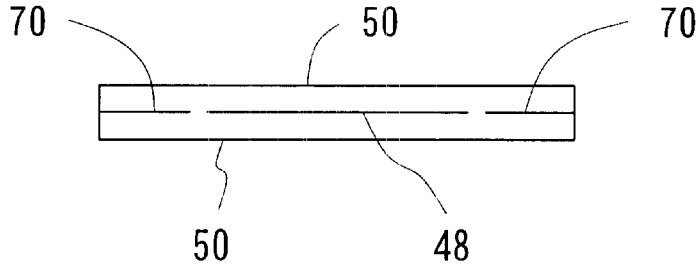
FIG. 10 is an elevational view of the guide means of FIG. 1.
Figure 11:
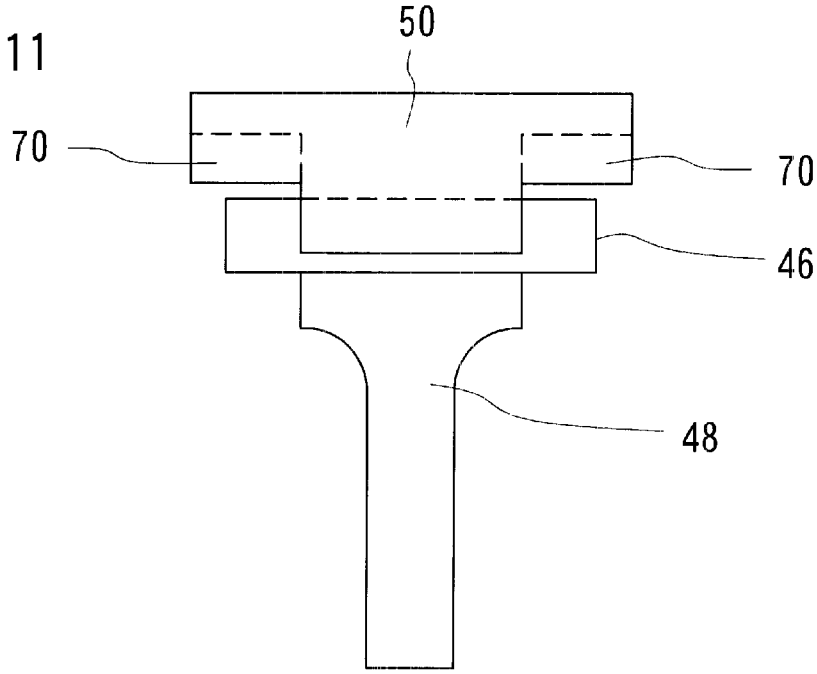
FIG. 11 is a plan view of the guide means of FIG. 10.

The guide means 50 is disposed between the holder 62 and the guide roller 68 so that the additional material 46 passes through the guide means 50 to be folded along the center line 20 of bottom gusset portion 18*a* and 18*b* and the folded lines 26 of first and second auxiliary gusset portions 22*a*, 22*b*, 24*a* and 24*b*, when inserting the additional material 46 by the spatula 48. Accordingly, the bottom gusset portion 18*a* and 18*b* is folded into halves, superposed into two layers and interposed between the layers of panel portion 2*a* and 2*b*. The first and second auxiliary gusset portions 22*a*, 22*b*, 24*a* and 24*b* are folded into halves, superposed into two layers and interposed between the layers of bottom gusset portion 18*a* and 18*b*. In the embodiment, the guide means comprises a pair of guide plates 50 spaced from each other vertically and opening toward the additional material 46 held in the holder 62. The spatula 48 and the additional material 46 are pushed between the guide plates 50 so that the bottom gusset portion 18*a* and 18*b* can be folded into halves and superposed into two layers. In addition, a pair of fins 70 are disposed between the guide plates 50, as shown in FIG. 10 and FIG. 11, so that the first and second auxiliary gusset portions 22*a*, 22*b*, 24*a* and 24*b* can be engaged with the fins 70 and pushed between the guide plates 50 to be folded into halves, superposed into two layers and interposed between the layers of bottom gusset portion 18*a* and 18*b*.

Figure 12:
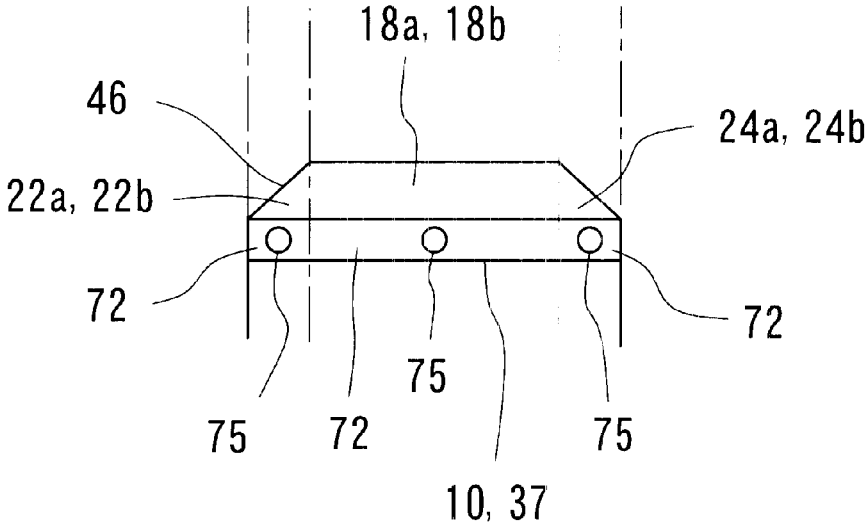
FIG. 12 is a schematic view of the additional material inserted between the layers of panel portion of FIG. 1.

In the embodiment, the gusset portion 18*a* and 18*b* and the first and second auxiliary gusset portions 22*a*, 22*b*, 24*a* and 24*b* include extensions 72 formed by the notches 66 when folded into halves and superposed into two layers, the extensions 72 being also inserted between the layers of panel portion 2*a* and 2*b*, as shown in FIG. 12. The apparatus includes an ultrasonic seal or heat seal apparatus 74 disposed above the guide roller 68 for ultrasonic sealing or heat sealing the layers of panel portion 2*a* and 2*b* with the extensions 72 at positions 75 to provisionally attach the additional material 46 to the main material 32 and then feed the main material 32 along with the additional material 46.

The apparatus further includes bottom gusset sealing means comprising heat seal bars 76 and rubber beds 78 which are disposed downstream of the inserting means along the feeding path. The heat seal bars 76 and the rubber beds 78 are connected to drive means which move the heat seal bars 76 and the rubber beds 78 upwardly and downwardly so that the main material 32 and the additional material 46 are sandwiched between and heated and pressurized by the heat seal bars 76 and the rubber beds 78 at a position of extensions 72, whenever feeding the main material 32 intermittently and during stopping it.

In this connection, each of the main and additional materials 32 and 46 comprises a laminated plastic film composed of a base material such as nylon and a sealant such as polyethylene or polypropylene which is laminated on the base material. The main material 32 has an outer surface formed by said base material and an inner surface formed by the sealant. The additional material 46 has opposite surfaces one of which is formed by the sealant and opposed to the main material 32 after inserting, the other surface of the additional material 46 being formed by the base material.

The heat seal bars 76 and the rubber beds 78 therefore heat seal the layers of panel portion 2*a* and 2*b* with the layers of bottom gusset portion 18*a* and 18*b* and heat seal the layers of first and second auxiliary gusset portions 22*a*, 22*b*, 24*a* and 24*b* with the layers of first and second side gusset portions 12*a*, 12*b*, 14*a* and 14*b* along the opening 37 respectively, at the position of extensions 72, whenever feeding the main material 32 intermittently and during stopping it. The main material 32 and the additional material 46 may be sandwiched between and heated and pressurized by heat seal bars for heat sealing without the rubber beds 78.

The apparatus further includes a cutter 80 disposed downstream of the bottom gusset sealing means along the feeding path for cutting the other layer of panel portion 2*b* along the opening 37 to form the bottom edges 10 of plastic bag, whenever feeding the main material 32 and during slopping it. The apparatus can therefore successively make the plastic bags shown in FIG. 2.

The cutter 80 may be arranged to cut the other layer of panel portion 2*b* as well as one of the layers of panel potion 2*a*, the layers of bottom gusset portion 18*a* and 18*b*, the layers of first and second auxiliary gusset portions 22*a*, 22*b*, 24*a* and 24*b* and the layers of first and second side gusset potions 12*a*, 12*b*, 14*a* and 14*b* along the opening 37 to form the bottom edges 10 of plastic bag. The cutter 80 may be further arranged to cut the other layer of panel portion 2*b* as well as one of the layers of panel portion 2*a*, the layers of bottom gusset portion 18*a* and 18*b*, the layers of first and second auxiliary gusset portions 22*a*, 22*b*, 24*a* and 24*b* and the layers of first and second side gusset portions 12*a*, 12*b*, 14*a* and 14*b* at two positions predetermined downstream and upstream of the opening 37. For example, it may be arranged to firstly cut all the layers at a position predetermined downstream of the opening 37. Suitable means then move the cutter 80 in a direction reverse to the feeding direction of main material 32 to cut all the layers at a position predetermined upstream of the opening 37. The feed rollers 34 may feed the main and additional materials 32 and 46 slightly to cut all the layers at the position predetermined upstream of the opening 37 without moving the cutter 80. The cutter 80 may includes two cutting edges spaced from each other in the feeding direction of main material 32 to cut all the layers at two positions.

Figure 13:
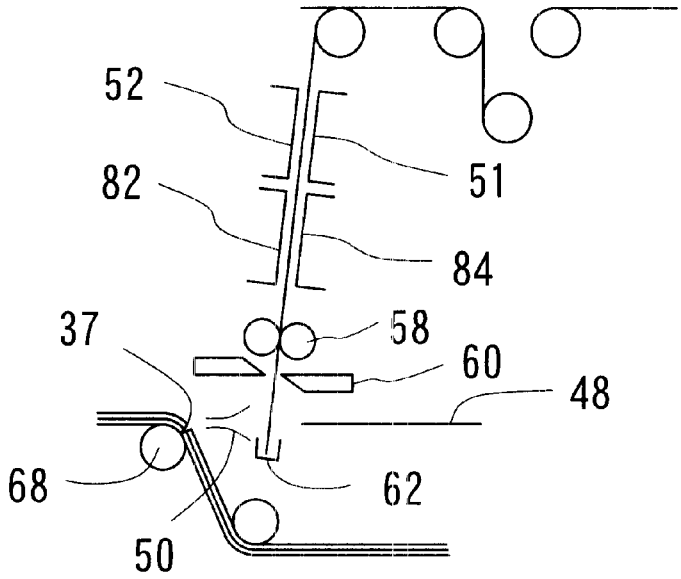
FIG. 13 is a side view of other embodiment.
Figure 14:
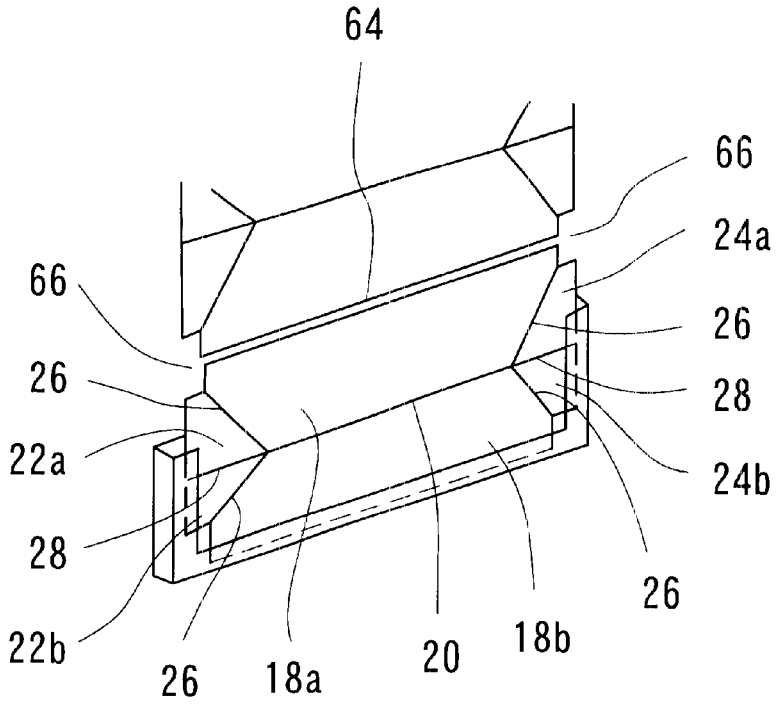
FIG. 14 is a perspective view of the holder of FIG. 13.

The folded tendency making means may comprises a heater or press 82 and a receiver 84 in addition to the heater or press 51 and the receiver 52, as shown in FIG. 13. The heater 51 and the receiver 52 are intended to make the additional material 46 having a tendency to be folded along the center line 20 of bottom gusset portion 18*a* and 18*b* and the folded lines 26 of first and second auxiliary gusset portions 22*a*, 22*b*, 24*a* and 24*b*, as in the case of the apparatus of FIG. 1. The heater 82 and the receiver 84 are intended to make the additional material having a tendency to be reversely folded along the center line 28 of first and second auxiliary gusset portions 22*a*, 22*b*, 24*a* and 24*b*, as shown in FIG. 14. The auxiliary gusset portions 22*a*, 22*b*, 24*a* and 24*b* can therefore be folded easily.

Figure 15:
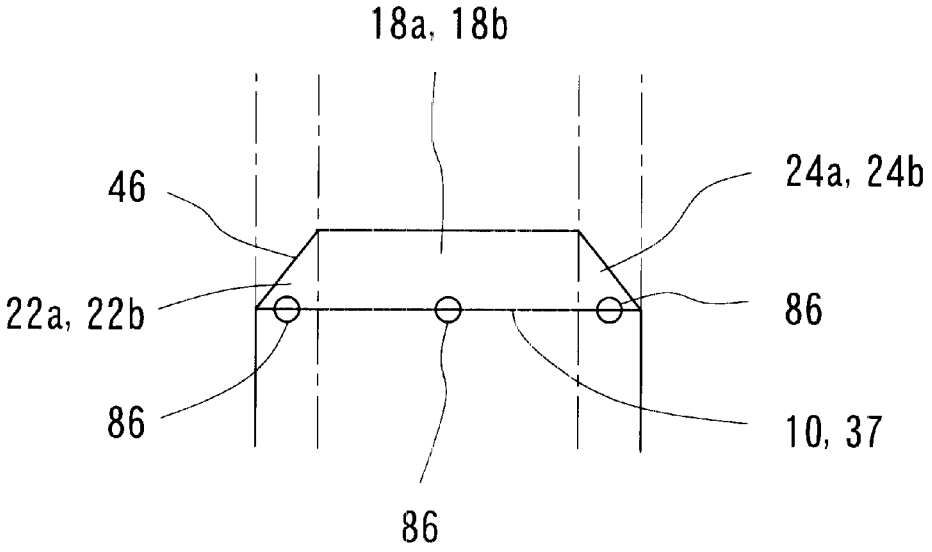
FIG. 15 is a schematic view of other embodiment.

The additional material 46 may be interested between the layers of panel portion 2*a* and 2*b* through the opening 37 without the extensions 72, as shown in FIG. 15. The ultrasonic seal or heat seal apparatus 74 then ultrasonic seals or heat seals the layers of panel portion 2*a* and 2*b* with the layers of bottom gusset portion 18*a* and 18*b* at positions 86 to provisionally attach the additional material 46 to the main material 32. The heat seal bars 76 then heat seals the layers of main material 32 with the layers of additional material 46 along the opening 37. The cutter 80 cuts the other layer of the panel portion 2*b* along the opening 37 to form the bottom edges 10 and make the plastic bag. The cutter 80 may cut all the layers at two positions predetermined downstream and upstream of the opening 37.

Figure 16:
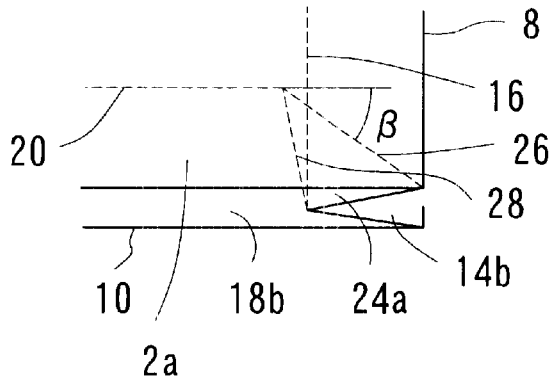
FIG. 16 is a perspective view of other embodiment.

Each of the first and second auxiliary gusset portions 22*a*, 22*b*, 24*a* and 24*b* may be folded from the layers of bottom gusset portion 18*a* and 18*b* along folded lines 26 extending at an angle β of 43 of 44° with respect to the center line 20 of bottom gusset portion 18*a* and 18*b*, as shown in FIG. 16. In the embodiment, the additional material 46 can be inserted between the layers of panel portion 2*a* and 2*b* without difficulty.

Figure 17:
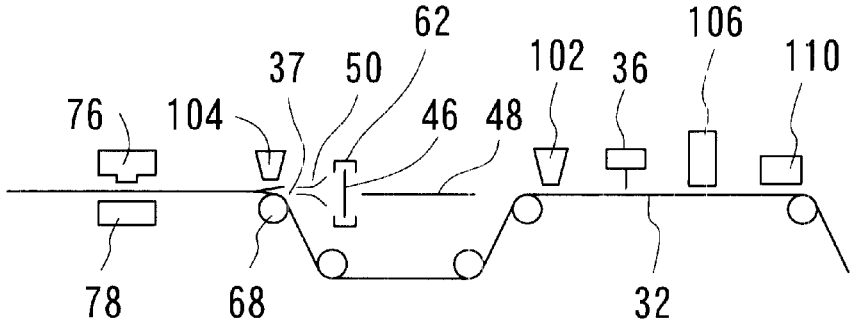
FIG. 17 is a side view of other embodiment.
Figure 18:
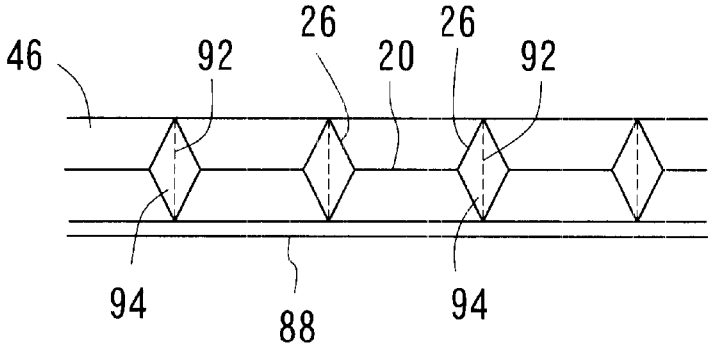
FIG. 18 is an elevational view of the additional material of FIG. 17.

In other embodiment shown in FIG. 17, the additional material 46 comprises the bottom gusset portion 18*a* and 18*b* continuing longitudinally thereof, a shown in FIG. 18. The additional material 46 extends horizontally and stands upright on a guide rail 88. A pair of feed rollers 90 feeds the additional material 46 intermittently for a length and horizontally along the guide rail 88, as shown in FIG. 19, the heater or press 51 and the receiver 52 making the additional material 46 having a tendency to be folded along the center line 20 of bottom gusset portion 18*a* and 18*b* and the folded lines 26 of first and second auxiliary gusset portions 22*a*, 22*b*, 24*a* and 24*b*.

In addition, a Thomson blade cuts the additional material 46 along cutting lines 92 and forms micro joints 94 along the cutting lines 92. The cutting lines 92 extend between adjacent bottom gusset portions 18*a* and 18*b* which are connected and continuous with each other by the micro joints 94. Though exaggeratedly shown, each of the micro joints 94 has a length of about 0.2 mm. The additional material 46 is further directed between a pair of feed rollers 96 which are rotated at a speed higher than the feed rollers 90 to feed the additional material 46.

Accordingly, the additional material 46 is pulled between the feed rollers 90 and 96. The feed rollers 96 therefore tear the micro joints 94 and cut off the additional material 46 along the cutter line 92 when the cutting line 92 and the micro joints 94 pass through the feed rollers 90. The additional material 46 is then discharged from the feed rollers 96 and inserted into the holder 62. The spatula 48 is then pressed against the center line 20 of bottom gusset portion 18*a* and 18*b* to insert the additional material 46 between the layers of panel portion 2*a* and 2*b* through the opening 37.

The feed rollers 96 may comprise a movable roller and a fixed roller, the movable roller being connected to a cylinder 98 and retracted from the mixer roller. The cylinder 98 moves the movable roller toward the fixed roller so that the additional material 46 is sandwiched between the movable and fixed rollers 96 when the cutting line 92 passes through the feed roller 90. The movable and fixed rollers 92 then tear the micro joints 94 and cut off the additional material 46 along the cutting line 92. It is preferable that the fixed roller is rotated by a drive motor, the movable roller being rotated by the fixed roller when the additional material 46 is sandwiched between them.

Figure 22:
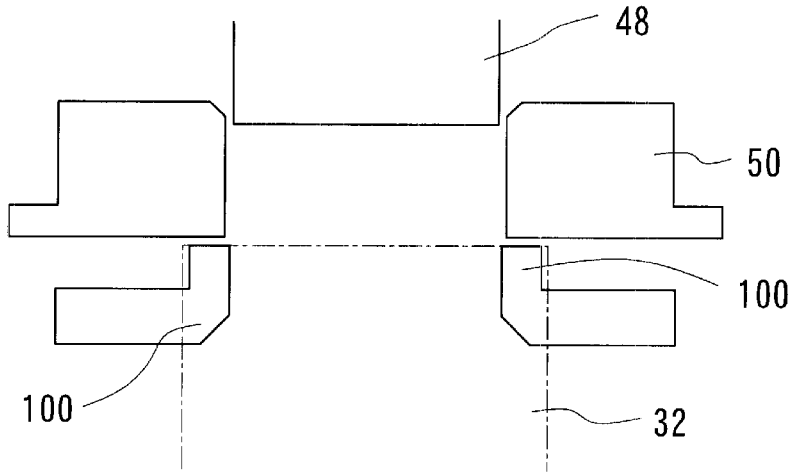
FIG. 22 is a plan view of the guide plates of FIG. 20.
Figure 23:
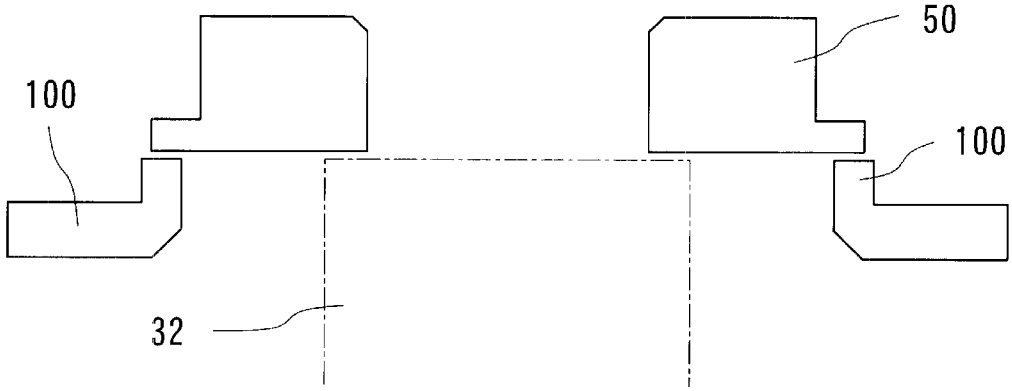
FIG. 23 is a plan view of the guide plates of FIG. 22 retracted.

In the embodiment of FIG. 17, a pair of guide plates 100 are connected by drive means such as cylinders which move the guide plates 100 widthwise of the main material 32 on the opposite sides thereof when the main material 32 is curved by the guide roller 68 to open the opening 37, as shown in FIG. 20, FIG. 21 and FIG. 22. The guide plates 100 are interested between the layers of first and second side gusset portions 12*a*, 12*b*, 14*a* and 14*b* to hold them. The spatula 48 then inserts the additional material 46 between the layers of panel portion 2*a* and 2*b* through the opening 37 so that one of the layers of first auxiliary gusset portion 22*a* can be interposed along the one of the layers of bottom gusset portion 18*a* between one of the layers of panel portion 2*a* and one of the layers of first side gusset portion 12*a*, the other layer of first auxiliary gusset portion 22*b* being interposed along with the other layer of bottom gusset portion 18*b* between the other layer of panel portion 2*b* and the other layer of first side gusset portion 12*b*, without difficulty. One of the layers of second auxiliary gusset portion 24*a* can be interposed along with one of the layers of bottom gusset portion 18*a* between one of the layers of panel portion 2*a* and one of the layers of second side gusset portion 14*a*, the other layer of second auxiliary gusset portion 24*b* being interposed along with the other layer of bottom gusset portion 18*b* between the other layer of panel portion 2*b* and the other layer of second side gusset portion 14*b*, without difficulty. The guide plates 100 is the retracted from the layers of first and second side gusset portions 12*a*, 12*b*, 14*a* and 14*b*, as shown in FIG. 23, before feeding the main material 32 intermittently again.

In the embodiment of FIG. 17, a suction pad 102 is disposed downstream of the cutting means 36 comprising the Thomson blade to suctionally attract one of the layers of panel portion 2*a* and temporarily open the opening 37, whenever feeding the main material 32 intermittenly and during stopping it. The feed rollers 34 then feed the main material 32 intermittently again so that the main material 32 is curved by the guide roller 68 to open the opening 37 again. This can open the opening 37 reliably. A suction pad 104 may be disposed above the guide roller 68 to suctionally attract one of the layers of panel portion 2*a* and reliably open the opening 37.

Figure 24:
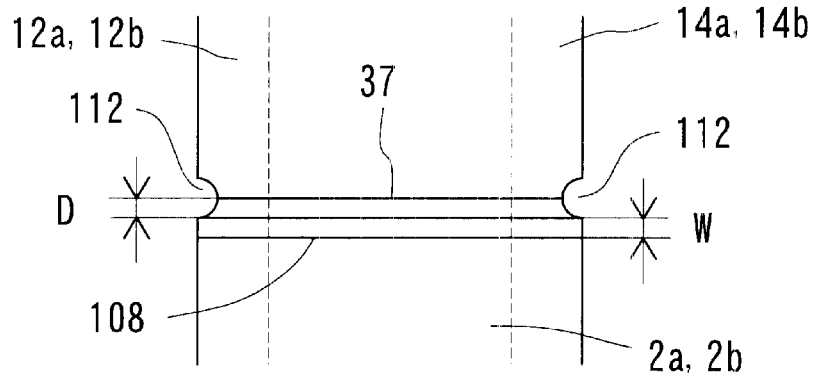
FIG. 24 is a plan view of the main material of FIG. 17.

In the embodiment of FIG. 17, an ultrasonic seal or heat seal apparatus 106 is disposed upstream of the cutting means 36 for ultrasonic sealing or heat sealing the layers of panel portion 2*a* and 2*b* and the layers of first and second side gusset portions 12*a*, 12*b*, 14*a* and 14*b* with each other to provisionally attach them to each other. This forms a provisional seal line 108 extending widthwise of the layers of panel portion 2*a* and 2*b* and having a width W of about 2.5 mm, as shown in FIG. 24. The cutting means 36 then cuts one of the layers of panel portion 2*a* as well as the layers of first and second side gusset portions 12*a*, 12*b*, 14*a* and 14*b* to form the opening 37 which is spaced from the provisional seal line 108 at a distance D of 1.5 to 2.0 mm. The provisional line 108 then keeps all the layers from opening upstream of the opening 37, when feeding the main material 34 again. This can prevent the opening 37 from being caught by guide rollers.

Figure 25:
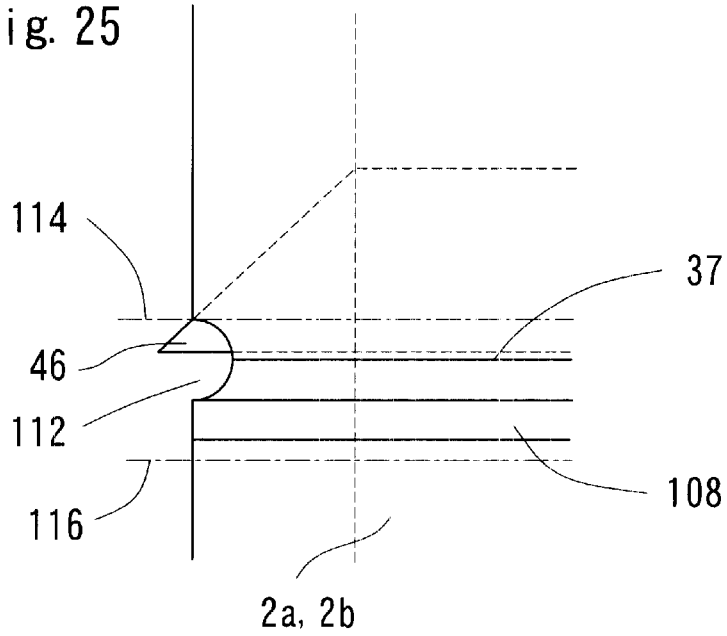
FIG. 25 is a plan view of the main material of FIG. 24 with the additional material inserted.

In the embodiment of FIG. 17, a punch 110 is disposed upstream of the ultrasonic seal or heat seal apparatus 106 to form notches 112 in all the layers of main material 34 at the first and second side edges 33. The cutting means 36 then forms the opening 37 at the center of the notches 112. It is therefore feasible to make the additional material 46 having a width larger than the main material 32 and insert it between the layers of panel portion 2*a* and 2*b* through the opening 37 so that the additional material 46 is pressed against the downstream ends of the notches 112, as shown in FIG. 25. This can insert the additional material 46 without difficulty. The cutter 80 then cuts all the layers of main and additional material 32 and 46 along a cutting line 114 predetermined downstream of the opening 37 and a cutting line 116 predetermined upstream of the opening 37 to make the plastic bag.

Figure 26:
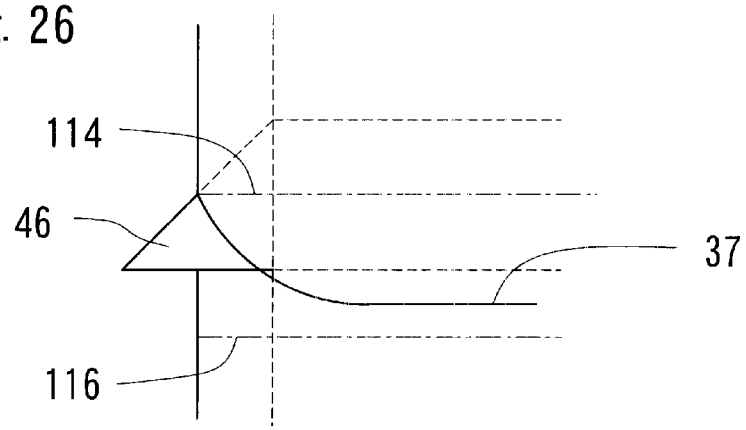
FIG. 26 is an enlarged view of other embodiment.

The cutting means 36 may form the opening 37 which includes portions curved downstream to extend toward the first and second side edges 6 and 8, as shown in FIG. 26. This can insert the additional material 46 between the layers of panel portion 2*a* and 2*b* so that the additional material 46 is pressed against the opposite ends of the opening 37. The cutter 80 then cuts all the layers of main and additional material 32 and 46 along the cutting lines 114 and 116.

Figure 27:
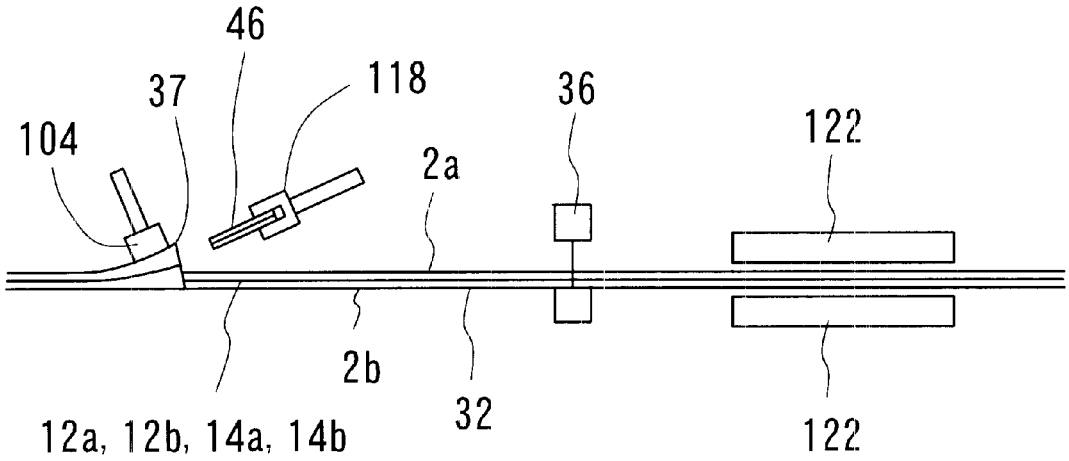
FIG. 27 is a side view of other embodiment.

The inserting means may comprise an autohand 118 arranged to clamp the additional material 46 which has been previously folded along the center line 20 of bottom gusset portion 18*a* and 18*b*, the folded lines 26 of first and second auxiliary gusset portions 22*a*, 22*b*, 24*a* and 24*b* and the center line 28 of first and second auxiliary gusset portions, as shown in FIG. 27. The autohand 118 then inserts the additional material 46 between the layers of panel portion 2*a* and 2*b* through the opening 37, whenever feeding the main material 32 intermittently and during stopping it.

Figure 28:
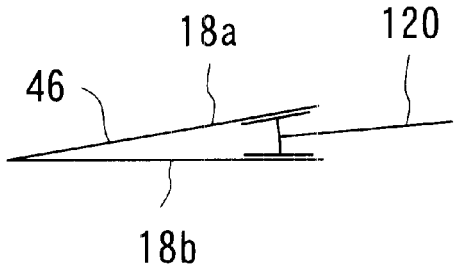
FIG. 28 is a side view of other embodiment.

The inserting means may comprise an autohand 120 arranged to be inserted between the layers of bottom gusset portions 18*a* and 18*b* for suctionally attracting the additional material 46 which has been previously folded along the center line 20, the folded lines 2*b* and the center lines 28, as shown in FIG. 28. The autohand 120 then inserts the additional material 46 between the layers of panel portion 2*a* and 2*b* through the opening 37.

In the embodiment of FIG. 27, the apparatus further includes side gusset sealing means comprising heat seal bars 122 which is disposed upstream of the inserting means and the cutting means 36 along the feeding path. The heat seal bars 122 heat seal the layers of panel portion 2*a* and 2*b* with the layers of first and second side gusset portions, 12*a*, 12*b*, 14*a* and 14*b* along the first and second side edges 6 and 8 respectively, whenever feeding the main material 32 intermittently and during stopping it, to form the heat seal lines 33 shown in FIG. 5.

Figure 29:
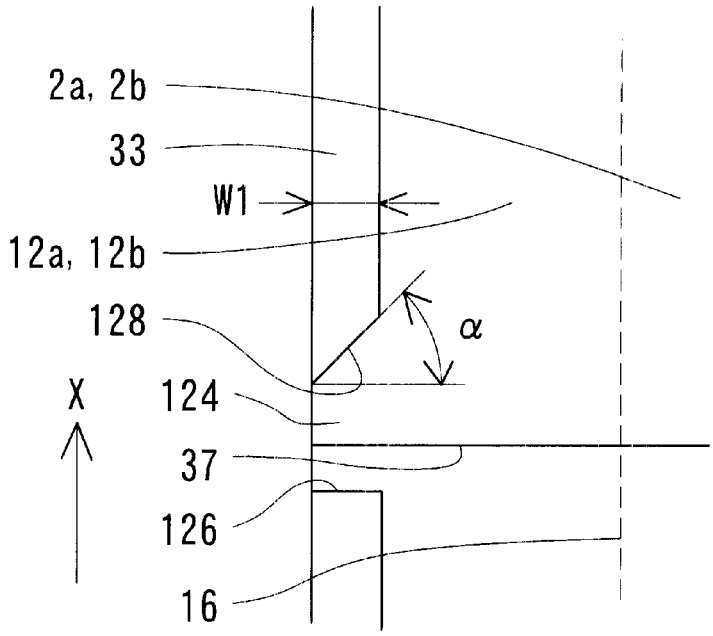
FIG. 29 is a plan view of other embodiment.

The heat seal bars 122 may be arranged to form non-sealing portions 124 within the range of seal width W1, as shown in FIG. 29. The non-sealing portions 124 are spaced from each other along the first and second side edges 6 and 8. In the embodiment, each of the non-sealing portions 124 has upstream and downstream ends 126 and 128, the upstream end 126 extending perpendicularly to the feeding direction X of main material 32. The downstream end 128 extends to incline at an angle α of about 45° with respect to the feeding direction X of main material 32. The cutting means 36 then cuts one of the layers of panel portion 2*a* as well as the layers of first and second side gusset portions 12*a*, 12*b*, 14*a* and 14*b* to thereby form the opening 37 in the main material 32.

Figure 30:
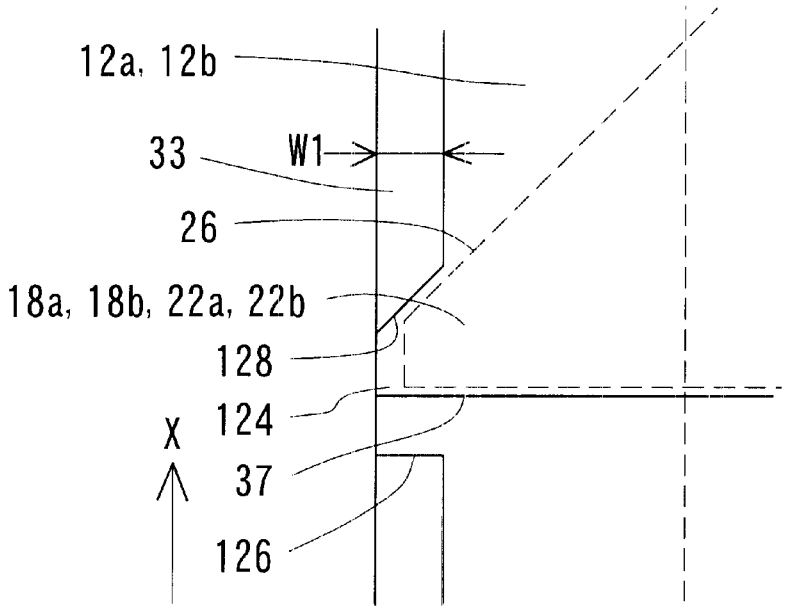
FIG. 30 is a plan view of a step next to that of FIG. 29.
Figure 31:
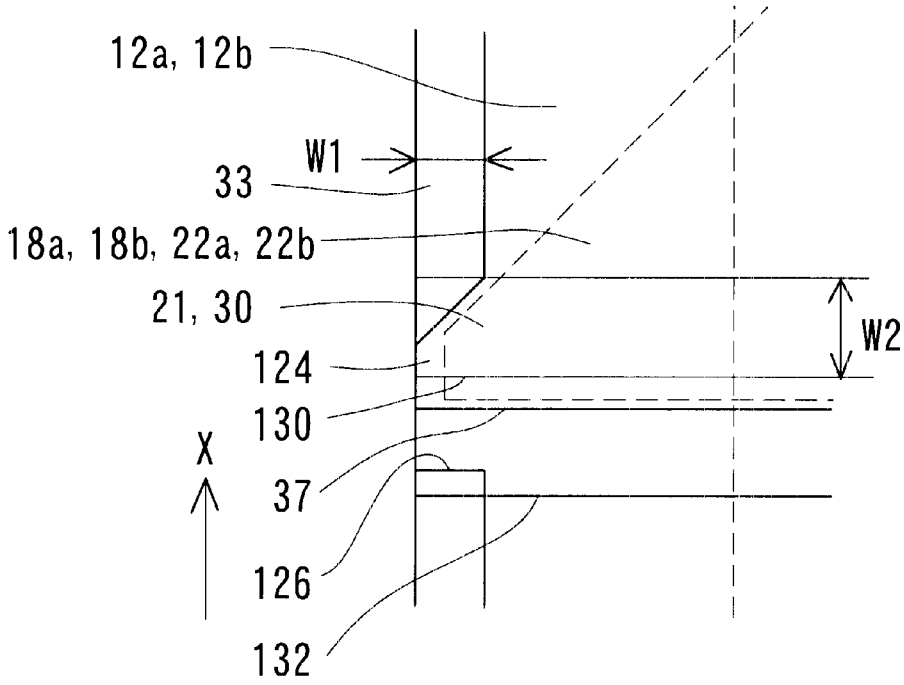
FIG. 31 is a plan view of a step next to that of FIG. 30.

The inserting means then inserts the additional material 46 between the layers of panel portion 2*a* and 2*b* through the opening 37 to make the bottom gusset portion 18*a* and 18*b* and the first and second auxiliary gusset portions 22*a*, 22*b*, 24*a* and 24*b* invading the non sealing portion 124, as shown in FIG. 30. The bottom gusset heat seal means then heat seals the layers of panel portion 2*a* and 2*b* with the layers of bottom gusset portion 18*a* and 18*b* and heat seals the layers of first and second auxiliary gusset portions 22*a*, 22*b*, 24*a* and 24*b* with the layers of first and second side gusset portions 12*a*, 12*b*, 14*a* and 14*b* along the opening 37 respectively, to form the heat seal lines 21 and 30 having a width W2, as shown in FIG. 31. In the case, the apparatus is advantageous in that it can heat seal the layers of panel portion 2*a* and 2*b* with the layers of first and second side gusset portions 12*a*, 12*b*, 14*a* and 14*b* in the non-sealing portion 124, to thereby closely heat seal all the layers of main and additional materials 32 and 46 with each other.

The cutter 80 then cuts the other layer of panel portion 2*b* along the opening 37 to form the bottom edges 10 and make the plastic bag. The cutter 80 may cut all the layers of main and additional materials 32 and 46 at a position 130 predetermined downstream of the opening 37 to make the plastic bag, the cutter 80 then cutting all the layers of main and additional material 32 and 46 at a position 132 predetermined slightly upstream of the non-sealing portion 124.

The apparatus can therefore make plastic bags in each of which the layers of panel portion 2*a* and 2*b* are heat sealed with the layers of bottom gusset portion 18*a* and 18*b* along the bottom edges 10 respectively so that the bottom edges 10 are connected with each other by the bottom gusset portions 18*a* and 18*b*. The layers of first and second auxiliary gusset portions 22*a*, 22*b*, 24*a* and 24*b* are heat sealed with the layers of first and second side gusset portions 12*a*, 12*b*, 14*a* and 14*b* along the bottom edges 10 respectively so that the first and second side gusset portions 12*a*, 12*b*, 14*a* and 14*b* are connected with the bottom gusset portion 18*a* and 18*b* by the first and second auxiliary gusset portion 22*a*, 22*b*, 24*a* and 24*b*. In addition, the layers of panel portion 2*a* and 2*b* are heat sealed with the layers of first and second side gusset portions 12*a*, 12*b*, 14*a* and 14*b* along the first and second side edges 6 and 8 respectively so that the first side edges 6 are connected with each other by the first side gusset portion 12*a* and 12*b*, the second side edges 8 being connected with each other by the second side gusset portion 14*a* and 14*b*. The bottom gusset portion 18*a* and 18*b* and the first and second auxiliary gusset portions 22*a*, 22*b*, 24*a* and 24*b* invade the ranges of seal width of the layers of panel portion 2*a* and 2*b* with the layers of first and second side gusset portions 12*a*, 12*b*, 14*a* and 14*b*.

Figure 32:
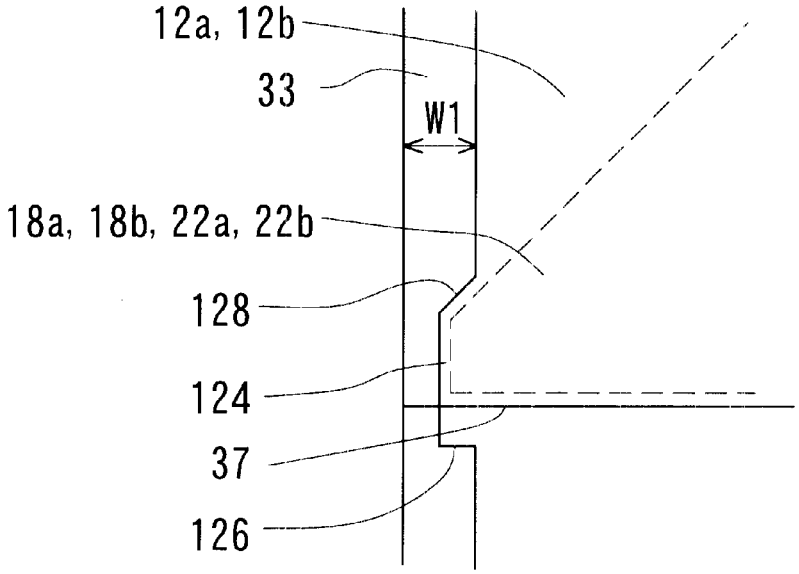
FIG. 32 is a plan view of other embodiment.
Figure 33:
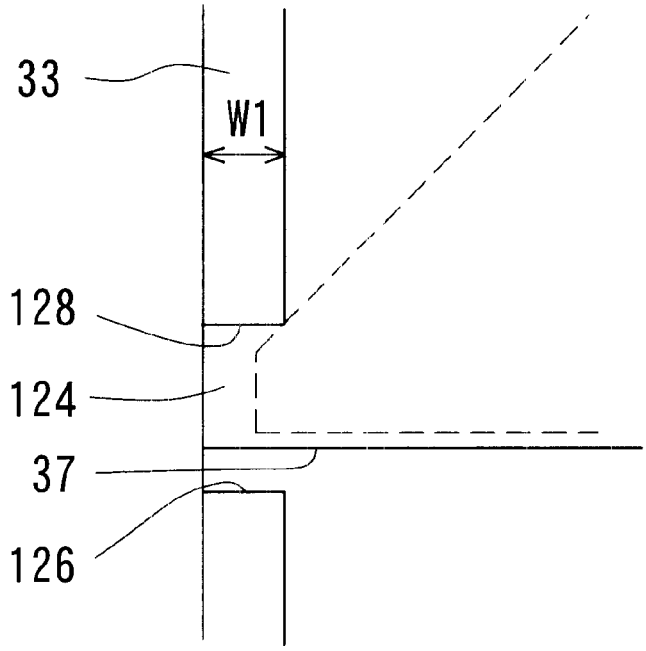
FIG. 33 is a plan view of other embodiment.
Figure 34:
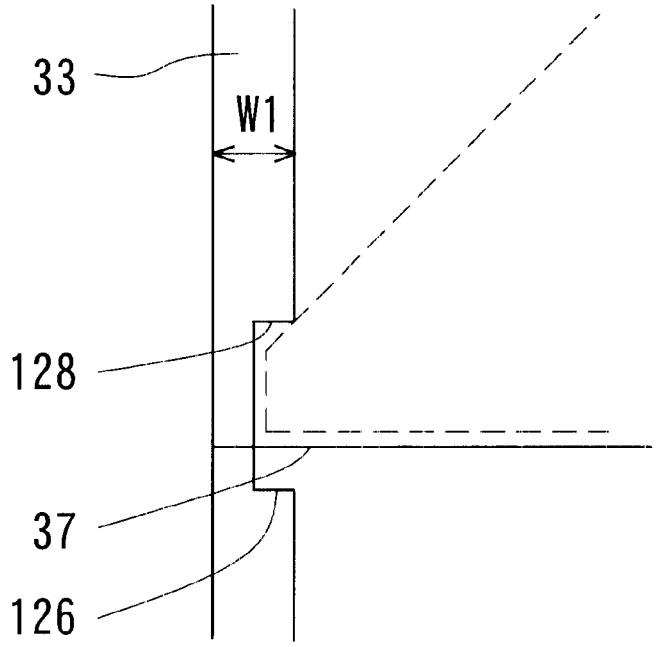
FIG. 34 is a plan view of other embodiment.
Figure 35:
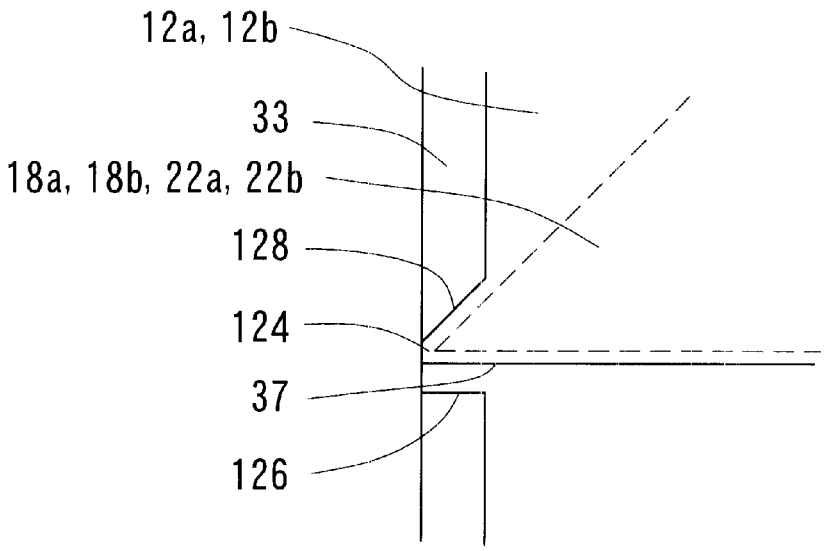
FIG. 35 is a plan view of other embodiment.
Figure 36:
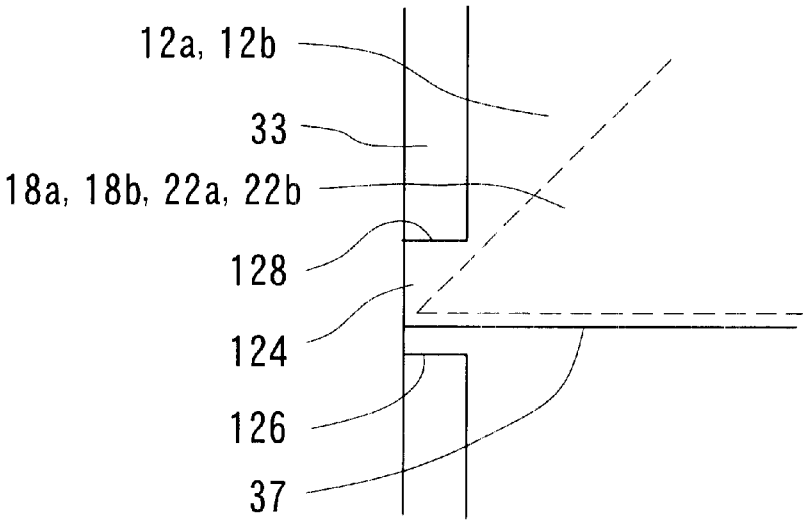
FIG. 36 is a plan view of other mebodiment.

The heat seal bars 122 may be arranged to form non-sealing portions 124 which partially spreads within the range of seal width W1, as shown in FIG. 32. The downstream end 128 may extend perpendicularly to the feeding direction X of main material 32, as shown in FIG. 33 and FIG. 34. The additional material 48 may have the extensions 72 of FIG. 12. The additional material 48 may be inserted between the layers of panel portions 2*a* and 2*b* without the extensions 72, as shown in FIG. 35 and FIG. 36.

Figure 37:
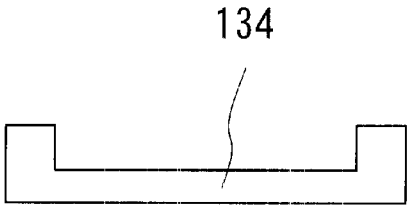
FIG. 37 is a plan view of other embodiment.

The bottom gusset heat seal means may include a heat seal bar 134 which is channel-shaped to reliably heat seal the layers of panel portion 2*a* and 2*b* with the first and second side gusset portion 12*a,* 12*b,* 14*a* and 14*b* in the non-sealing portion 124, as shown in FIG. 37.

Figure 38:
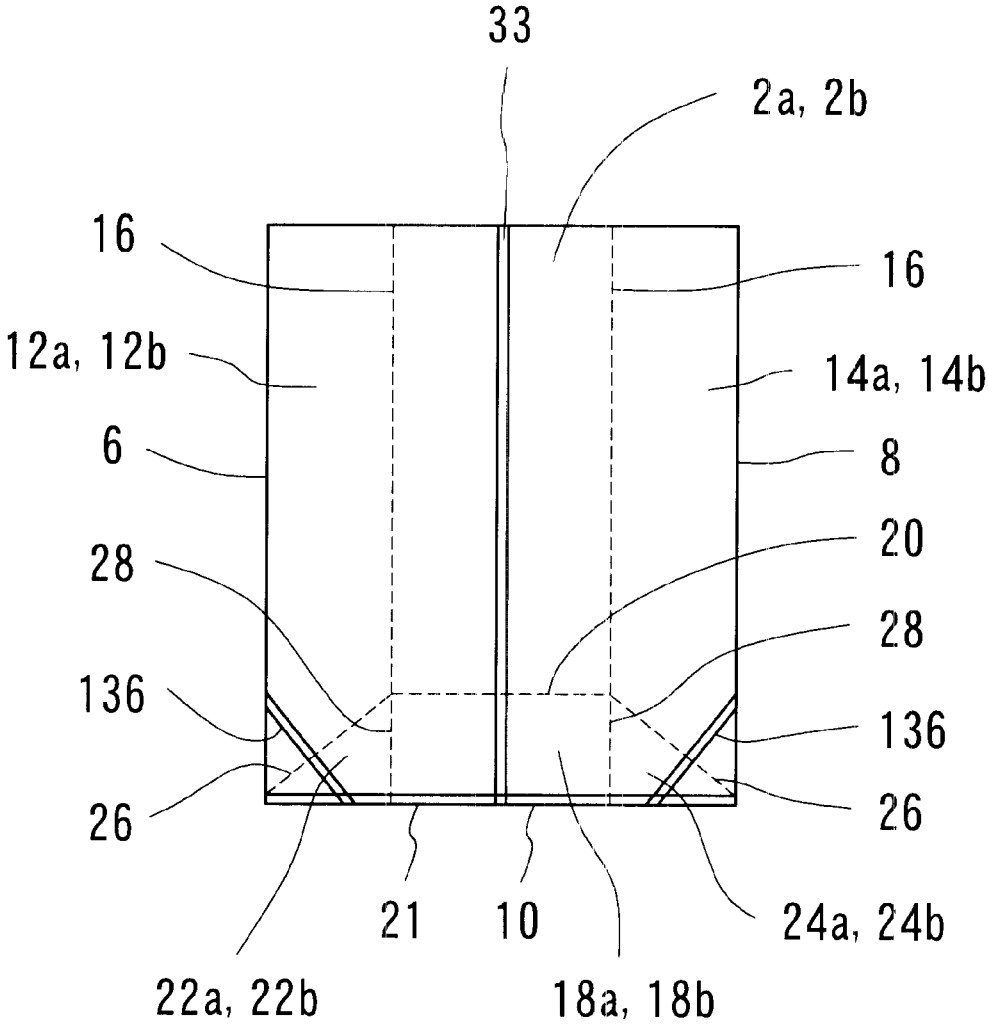
FIG. 38 is an elevational view of other embodiment.
Figure 39:
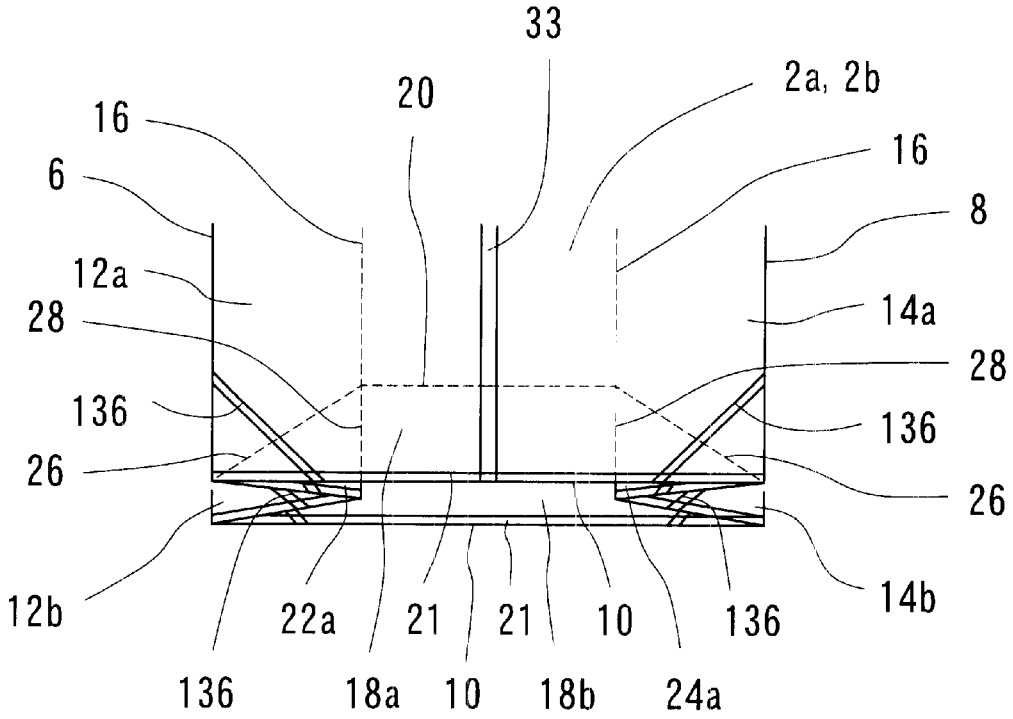
FIG. 39 is a perspective view of the plastic bag of FIG. 38.

The bottom gusset sealing means may be arranged to further heat seal the layers of panel portions 2*a* and 2*b* with the layers of bottom gusset portions 18*a* and 18*b* and the layers of first and second side gusset portions 12*a,* 12*b,* 14*a* and 14*b* and heat seal the layers of first and second auxiliary gusset portions 22*a,* 22*b,* 24*a* and 24*b* with the layers of first and second side gusset portions 12*a,* 12*b,* 14*a* and 14*b* at corners between the bottom edges 10 and the first and second side edges 6 and 8 respectively, to form joining lines 136 extending to traverse obliquely the bottom edges 10 and the first and second side edges 6 and 8, as shown in FIG. 38 and FIG. 39. The joining lines 136 therefore comprise heat seal lines.

The apparatus can therefore make plastic bags in each of which the first side edges 6 are connected with each other by the first side gusset portions 12*a* and 12*b,* the second side edges 8 being connected with each other by the second side gusset portion 14*a* and 14*b,* the bottom edges 10 being connected with each other by the bottom gusset portion 18*a* and 18*b*. The plastic bag includes joining lines 136 formed at corners between the bottom edges 10 and the first and second side edges 6 and 8 and extending to traverse obliquely the bottom edges 10 and the first and second side edges 6 and 8. The layers of panel portion 2*a* and 2*b* are joined with the layers of bottom gusset portion 18*a* and 18*b* and the layers of first and second side gusset portion 12*a,* 12*b,* 14*a* and 14*b* along the joining lines 136. The layers of first and second auxiliary gusset portions 22*a,* 22*b,* 24*a* and 24*b* are joined with the layers of first and second side gusset portions 12*a,* 12*b,* 14*a* and 14*b* along the joining lines 136 so that the first and second side gusset portions 12*a,* 12*b,* 14*a* and 14*b* are connected with the bottom gusset portion 18*a* and 18*b* by the first and second auxiliary gusset portions 22*a,* 22*b,* 24*a* and 24*b*. In the case, bottom gusset portions 18*a* and 18*b* and the first and second auxiliary gusset portions 22*a,* 22*b,* 24*a* and 24*b* are reasonably restrained from being unfolded at four corners of bottom of plastic bag by the joining lines 136. The four corner can therefore be prevented from being angular. The joining lines 136 comprise heat seal lines, the layers of panel portion 2*a* and 2*b* being heat sealed and joined with the layers of bottom gusset portion 18*a* and 18*b* and the layers of first and second side gusset portions 12*a,* 12*b,* 14*a* and 14*b* along the heat seal lines 136, the layers of first and second auxiliary gusset portions being heat sealed and joined with the layers of first and second side gusset portions 12*a,* 12*b,* 14*a* and 14*b* along the heat seal lines 136.

The joining lines 136 may comprise straight or curved lines.

Figure 40:
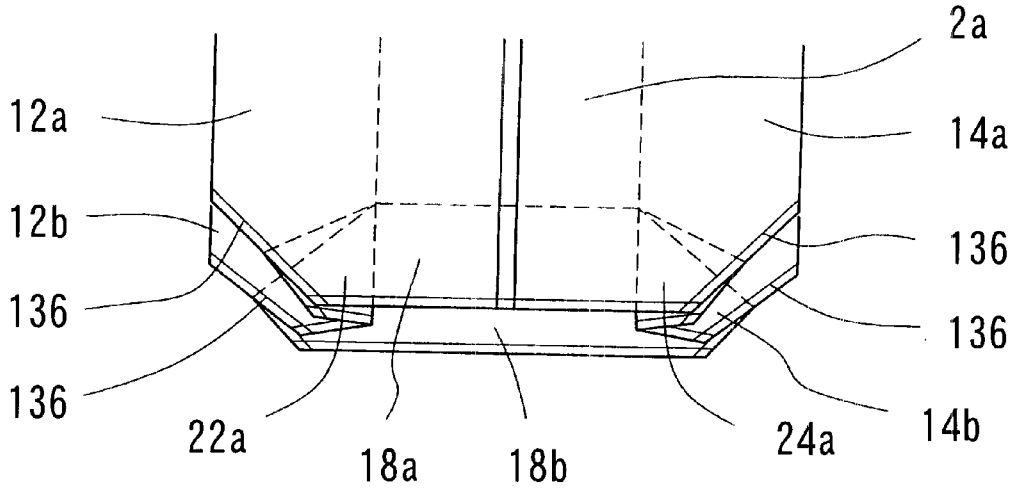
FIG. 40 is a perspective view of other embodiment.

The cutter 80 may be arranged to cut the layers of panel portion 2*a* and 2*b,* the layers of bottom gusset portion 18*a* and 18*b,* the layers of first and second auxiliary gusset portions 22*a,* 22*b,* 24*a* and 24*b* and the layers of first and second side gusset portions 12*a,* 12*b,* 14*a* and 14*b* along the joining lines 136 which comprise straight lines, as shown in FIG. 40.

Figure 41:
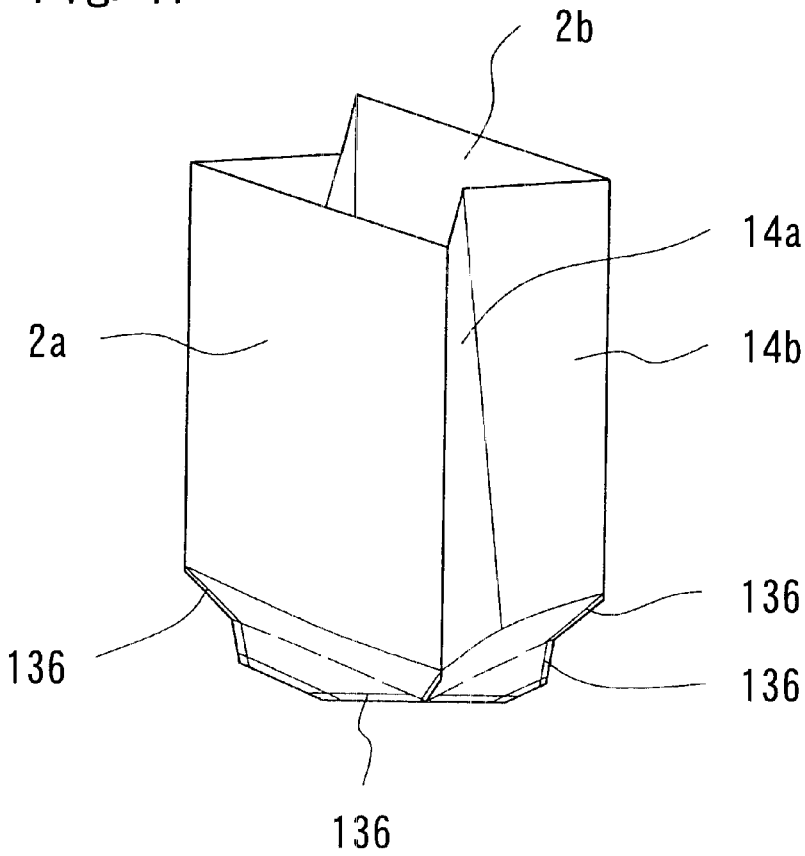
FIG. 41 is a perspective view of the plastic bag of FIG. 40 standing.
Figure 42:
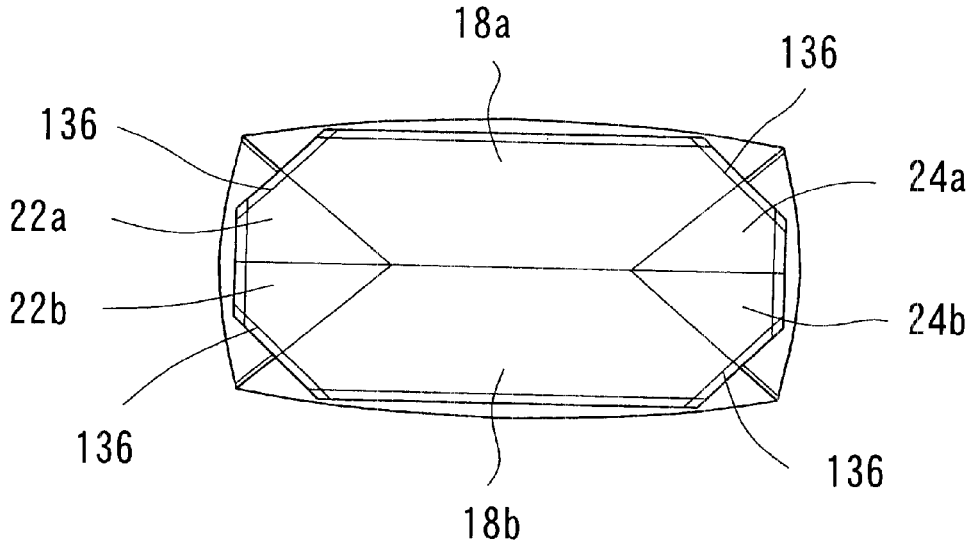
FIG. 42 is a bottom view of the plastic bag of FIG. 41.
Figure 43:
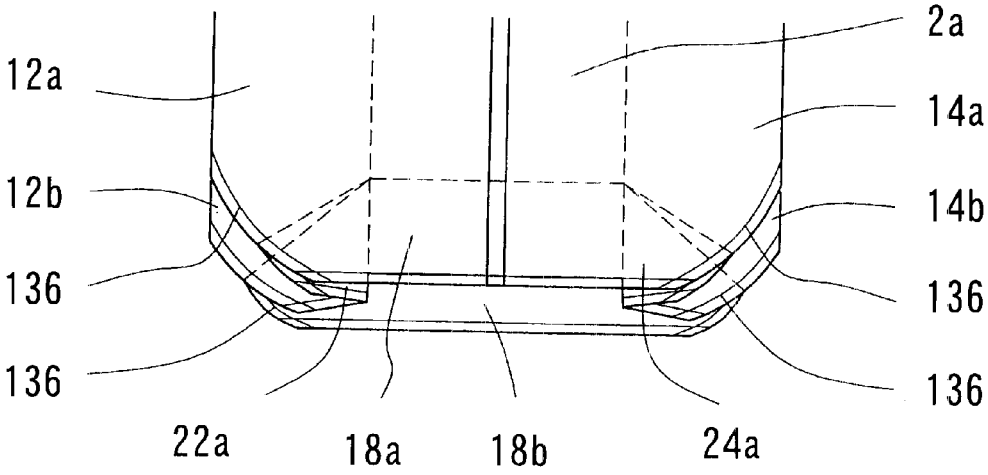
FIG. 43 is a perspective view of other embodiment.
Figure 44:
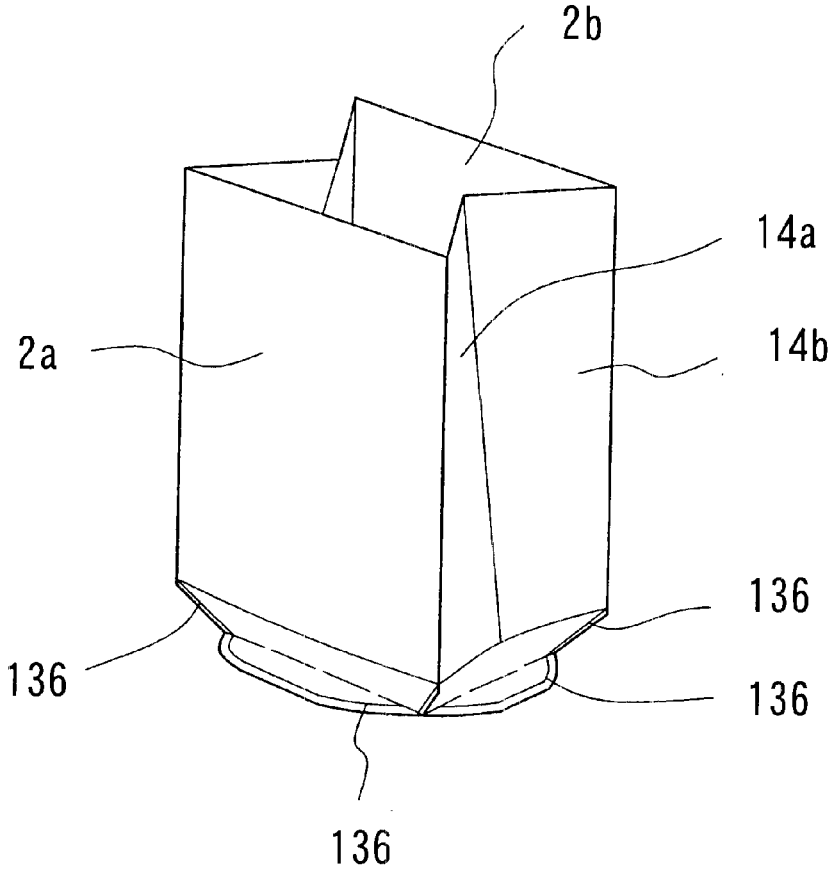
FIG. 44 is a perspective view of the plastic bag of FIG. 43 standing.
Figure 45:
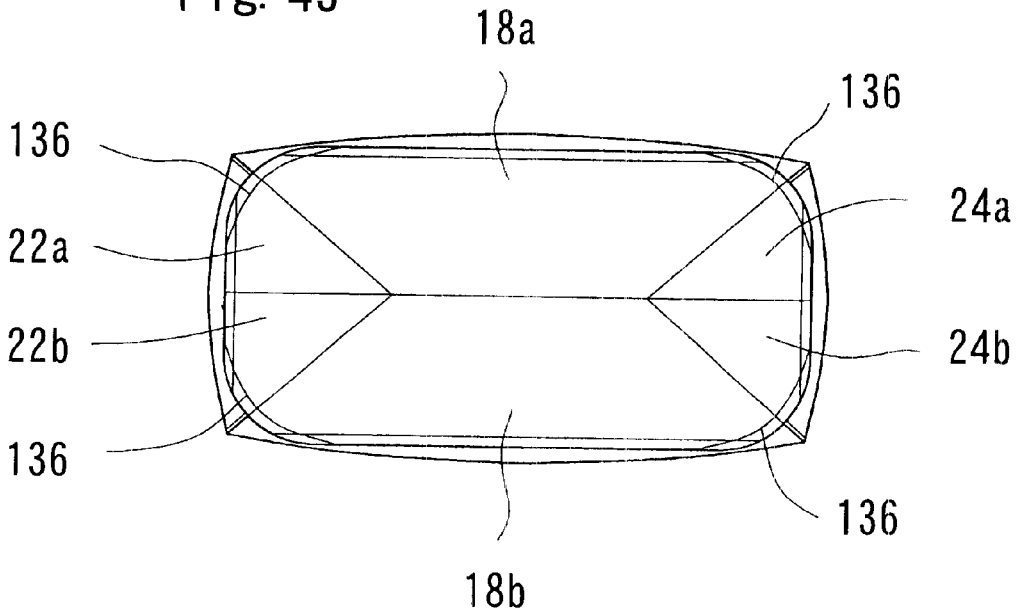
FIG. 45 is a bottom view of the plastic bag of FIG. 44.

The apparatus can therefore make plastic bags in each of which the layers of panel portion 2*a* and 2*b,* the layers of bottom gusset portion 18*a* and 18*b,* the layers of first and second auxiliary gusset portions 22*a,* 22*b,* 24*a* and 24*b* and the layers of first and second side gusset portions 12*a,* 12*b,* 14*a* and 14*b* are corner cut along the joining lines 136. In the case, all the layers of main and additional materials 32 and 46 can be folded outwardly to form a flat bottom of plastic bag when the bottom gusset portions 18*a* and 18*b* and the first and second auxiliary gusset portions 22*a,* 22*b,* 24*a* and 24*b* are unfolded between the bottom edges 10, as shown in FIG. 41 and FIG. 42. The plastic bag includes a constricted portion disposed above the bottom to have an appearance of receptacle.

it may cut all the layers of main and additional material along joining lines 136 which comprise curved lines, as shown in FIG. 43, FIG. 44 and FIG. 45.

Figure 46:
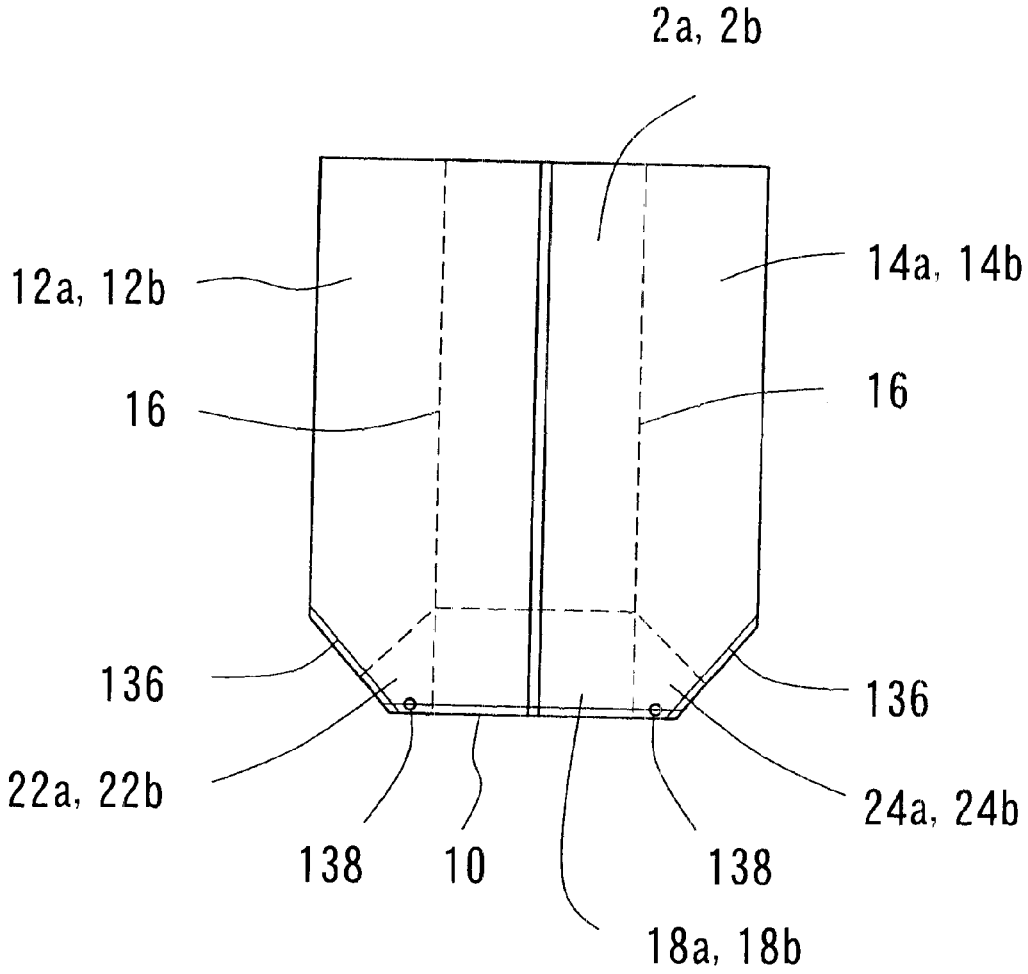
FIG. 46 is an elevational view of other embodiment.

The layers of panel portion 2*a* and 2*b* may be spot joined with the layers of bottom gusset portion 18*a* and 18*b,* the layers of first and second auxiliary gusset portions 22*a,* 22*b,* 24*a* and 24*b* and the layers of first and second side gusset portions 12*a,* 12*b,* 14*a* and 14*b* respectively at positions 138 adjacent the bottom edges 10 and between the center lines 16 of first and second side gusset portions 12*a,* 12*b,* 14*a* and 14*b* and the joining lines 136, as shown in FIG. 46. This plastic bag obtain a reduction of bottom by the spot joined positions 138.

Figure 47:
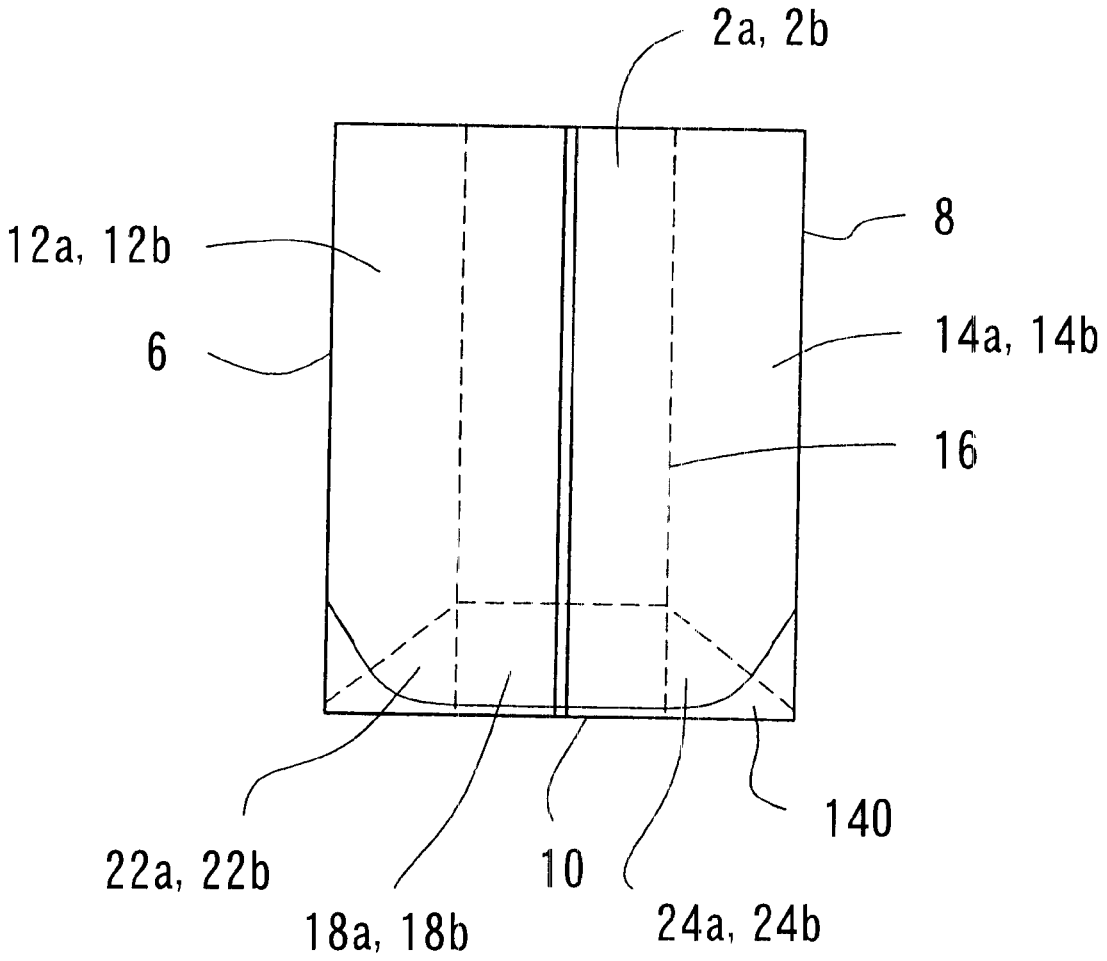
FIG. 47 is an elevational view of other embodiment.

The plastic bag may have an heat seal area 140 formed along the bottom edge 10 and the sides edges 6 and 8, as shown in FIG. 47.

What is claimed is:

1. An apparatus for successively making plastic bags each of which includes two layers of panel portion superposed to define aligned top edges, first and second side edges and bottom edges, and plastic bag further including a first side gusset portion disposed between and extending along said first side edges, a second side gusset portion disposed between and extending along said second side edges, and a bottom gusset portion disposed between and extending along said bottom edges, said apparatus comprising:

feeding means for feeding a main material intermittently for a length along a feeding path, said main material comprising said layers of panel portion and said first and second side gusset portions continuing longitudinally thereof respectively, said feeding means feeding said main material longitudinally of said layers of panel portion and said first and second side gusset portions;

cutting means disposed at a position determined along said feeding path for cutting one of said two layers of panel portion as well as said first and second side gusset portions widthwise of said main material and leaving the other said two layers of panel portion continuing, to form an opening in said main material, whenever feeding said main material intermittently;

inserting means disposed downstream of said cutting means along said feeding path for inserting an additional material between said layers of panel portion through said opening, whenever feeding said main material intermittently, said additional material comprising said bottom gusset portion;

wherein each of said first and second side gusset portions is folded into halves along a center line extending longitudinally thereof, superposed into two layers and interposed between said layers of panel portion, said first side edge being connected with each other by said first side gusset portion, said second edges being connected with each other by said second gusset portion, said bottom gusset portion being folded into halves along a center line extending longitudinally thereof, superposed into two layers and interposed between said layers of panel portion, said bottom edges being connected with each other by said bottom gusset portion, said bottom gusset portion having first and second ends at which first and second auxiliary gusset portions are formed, each of said first and second auxiliary gusset portions being folded from said layers of bottom gusset portion along folded lines extending at an angle of about 45° with respect to said center line of bottom gusset portions, said first auxiliary gusset portion being further folded into halves along a center line which is an extension of said center line of bottom gusset portions, to be superposed into two layers, one of which is interposed along with one of said two layers of bottom gusset portion between of said two layers of panel portion and one of said two layers of first side gusset portion, the other of said two layers of first auxiliary gusset portion being interposed along with the other said two layers of bottom gusset portions between the other of said two layers panel portion and the other of said two layers of fist side gusset portion, said first gusset portion being connected with said bottom gusset portion by said first auxiliary gusset portion, said second auxiliary gusset portion being further folded into halves along a center line which is an extension of said center line of bottom gusset portion, to be superposed into two layers, one of which is interposed along with one of said two layers of bottom gusset portion between one of said two layers of panel portion and one of said two layers of second side gusset portion, the other of said two layers of second auxiliary gusset portion being interposed along with the other of said two layers of bottom gusset portion between the other of said two layers of bottom gusset portion of panel portion and the other of two layers of second side gusset portion, said second side gusset portion being connected with said bottom gusset portion, said second side gusset portion by said second auxiliary gusset portion; and bottom gusset sealing means disposed downstream of said inserting means along said feeding path for heat sealing said layers of panel portion with said layers of bottom gusset portion and heat sealing said layers of first and second auxiliary gusset portions with said layers of first and second side gusset portions along said opening respectively, whenever feeding said main material intermittently.

2. The apparatus as set forth in claim 8 wherein said cutting means comprises a Thomson blade extending widthwise of an opposed to said one of said layers of panel portion, and drive means for moving said Thomson blade toward said one of said layers of panel portions to cut said one of said layers of panel portion as well as said first and second side gusset portions widthwise of said main material.

3. The apparatus as set forth in claim 1 wherein said inserting means comprises a spatula adapted to be pressed against said center line of bottom gusset portion to insert said additional material between said layers of panel portion through said opening.

4. The apparatus as set forth in claim 3 further comprising guide means through which said additional material passes to be folded along said center line of bottom gasket portion and said folded lines of first and second auxiliary gusset portions, when inserting said additional material by said spatula.

5. The apparatus as set forth in claim 4 further comprising folded tendency making means for making said additional material having a tendency to be folded along said center line of bottom gusset portion and said folded lines of first and second auxiliary gusset portions, said spatula being pressed against said center line of bottom gusset portion to insert said additional material, after making said additional material having a tendency to be folded.

6. The apparatus as set forth in claim 1 wherein said inserting means comprises an autohand arranged to clamp or suctionally attract said additional material which has been previously folded along said center line of bottom gusset portion, said folded lines of first and second auxiliary gusset portions and said center lines of first and second auxiliary gusset portions, said autoband inserting said additional material between said layers of panel portion through said opening.

7. The apparatus as set forth in claim 1 further comprising a cutter disposed downstream of said bottom gusset sealing means along said feeding path for cutting said other layer of panel portion along said opening to form said bottom edges of plastic bag, whenever feeding said main material intermittently.

8. The apparatus as set forth in claim 7 wherein said cutter is arranged to cut said other layer of panel portion as well as said one of said layers of panel portion, said layers of bottom gusset portion, said layers of first and second auxiliary gusset portions and said layers of first and second side gusset portions along said opening to form said bottom edges of plastic bag.

9. The apparatus as set forth in claim 8 wherein said cutter is further arranged to cut said other layer of panel portion as well as said one of said layers of panel portion, said layers of bottom gusset portion, said layers of first and second auxiliary gusset portion and said layers of first and second gusset portions at two positions predetermined downstream and upstream of said opening.

10. The apparatus as set forth in claim 7 further comprising side gusset sealing means disposed upstream of said inserting means along said feeding path for heat sealing and layers of panel portion with said layers of first and second side gusset portions along said first and second side edges respectively so as to form non-sealing portions within the range of seal width, whenever feeding said main material intermittently, said non-sealing portions being spaced from each other along said first and second side edges, said inserting means then inserting said additional material between said layers of panel portion to make said bottom gusset portion and said first and second auxiliary gusset portions invading said non-sealing portions, said bottom sealing means then heat sealing said layers of panel portion with said layers of bottom gusset portion and heat sealing said layers of first and second auxiliary gusset portion with said layers of first and second side gusset portion along said opening respectively.

11. The apparatus as set forth in claim 7 wherein said bottom gusset sealing means is arranged to further heat seal said layers of panel portion with said layers of bottom gusset portion and said layers of first and second side gusset portions and heat seal said layers of first and second auxiliary gusset portions with said layers of first and second side gusset portions at corners between said bottom edges and said first and second side edges respectively, to form joining lines extending to traverse obliquely said bottom edges and said first and second side edges.

12. The apparatus as set forth in claim 11 wherein said joining lines comprise straight or curved lines.

13. The apparatus as set forth in claim 12 wherein said cutter is arranged to cut said layers of panel portion, said layers of bottom gusset portion, said layers of first and second auxiliary gusset portions and said layers of first and second side gusset portions along said joining lines.

* * * * *

UNITED STATES PATENT AND TRADEMARK OFFICE

CERTIFICATE OF CORRECTION

PATENT NO. : 6,561,963 B2
DATED : May 13, 2003
INVENTOR(S) : Mikio Totani

It is certified that error appears in the above-identified patent and that said Letters Patent is hereby corrected as shown below:

Column 17,
Line 35, change "claim 8" to -- claim 1 --

Signed and Sealed this

Twentieth Day of January, 2004

JON W. DUDAS
*Acting Director of the United States Patent and Trademark Office*